US009226621B1

(12) United States Patent
Jones et al.

(10) Patent No.: US 9,226,621 B1
(45) Date of Patent: Jan. 5, 2016

(54) SINK SPLASH GUARD

(71) Applicants: Wayne David Jones, Larksville, PA (US); David D. McClanahan, Harleysville, PA (US)

(72) Inventors: Wayne David Jones, Larksville, PA (US); David D. McClanahan, Harleysville, PA (US)

( * ) Notice: Subject to any disclaimer, the term of this patent is extended or adjusted under 35 U.S.C. 154(b) by 303 days.

(21) Appl. No.: 13/840,638

(22) Filed: Mar. 15, 2013

(51) Int. Cl.
*A47J 47/20* (2006.01)

(52) U.S. Cl.
CPC ..... *A47J 47/20* (2013.01)

(58) Field of Classification Search
CPC ..... E03C 1/181; A47J 47/20
USPC ..... 4/658, 559
See application file for complete search history.

(56) References Cited

U.S. PATENT DOCUMENTS

| | | | | |
|---|---|---|---|---|
| 1,225,256 | A * | 5/1917 | Lambrix | 134/201 |
| 1,579,374 | A | 4/1926 | Leighton | |
| 2,508,808 | A | 5/1950 | Warman | |
| 4,878,257 | A | 11/1989 | Hardin | |
| 5,012,537 | A | 5/1991 | Underwood | |
| 5,231,707 | A | 8/1993 | Ashley et al. | |
| 5,249,315 | A | 10/1993 | Moylan | |
| 5,625,910 | A | 5/1997 | Erickson et al. | |
| D388,867 | S | 1/1998 | Baca | |
| D389,232 | S | 1/1998 | Pangowski | |
| 6,212,708 | B1 | 4/2001 | Mulaw | |
| 6,253,395 | B1 | 7/2001 | Quam | |
| 6,564,398 | B1 | 5/2003 | Trott | |
| 6,701,543 | B1 | 3/2004 | Haq | |
| 6,959,461 | B1 | 11/2005 | Sanchez | |
| 7,269,861 | B1 | 9/2007 | Miller | |
| 8,214,939 | B2 | 7/2012 | Spurlock | |
| 2009/0158521 | A1 * | 6/2009 | Richardson et al. | 4/572.1 |
| 2012/0125728 | A1 * | 5/2012 | Tamarkin | 190/13 R |

* cited by examiner

*Primary Examiner* — Janie Christiansen
(74) *Attorney, Agent, or Firm* — Richard M. Blank, Esq.

(57) ABSTRACT

The disclosed technology is a sink splash guard that easily attaches and detaches to a sink to prevent water from splashing onto a person washing hands or utensils in the sink. The panel of the sink splash guard is made of a flexible plastic so that it folds over itself and includes means to attach to itself, such that the user has the option to fold the splash guard out of the way or remove it, when it is not needed.

12 Claims, 31 Drawing Sheets

SINK SPLASH GUARD

FIELD OF THE DISCLOSED TECHNOLOGY

The disclosed technology relates to a device easily attached to a sink or basin to prevent water from splashing onto a person washing dishes, hands or other utensils in the sink and the method of making the same.

BACKGROUND OF THE DISCLOSED TECHNOLOGY

Dishwashing machines are used in many homes, but they have their limitations. Even with a dishwashing machine, many things such as oversized pots need to be cleaned by hand in the sink. There are also homes with no dishwashing machines and thus there is no other option than to wash the dishes by hand. Getting splashed or sprayed is a common consequence of washing by hand.

One could wear an apron, but it would be easier to have a convenient shield in the sink or basin to prevent the person from being splashed or sprayed. The current splash guard system would be low profile, easy to use and easy to store. The appearance of the device can be enhanced by placing a logo on it, such as that of a sports team.

The splash guard would be tablet shaped having a plurality of suction cups attached to the bottom portion of a panel. The suction cups are used to easily attach and detach the splash guard from a sink wall directly in front of the person performing the washing function. The splash guard would be made of a flexible plastic material and further have the ability to fold over itself, roughly in half, attach to itself and be stored out of the way while still attached to the sink.

Alternatively, the splash guard can simply be removed from the sink when not needed and hung somewhere in the kitchen from an aperture in the panel. Another alternative is removal of the splash guard panel from the suction cups when not needed and also hung somewhere in the kitchen from the aperture in the panel.

SUMMARY OF THE DISCLOSED TECHNOLOGY

The disclosed technology described herein addresses an unfulfilled need in the prior art, by providing a simple sink splash guard of a convenient size and easy to store both in and out of the sink.

One objective of the disclosed technology is to have a sink splash guard having a panel for increasing the vertical extension of a basin wall to protect a person's torso from splashing liquid. The panel acts as a shield for said torso by extending vertically beyond said basin wall. The panel is maintained between the torso and the basin, thereby allowing a person to reach around the panel into the basin.

The panel would further comprise of at least two suction cups at a bottom portion and on one side of the panel. The suction cups attaches the panel to the basin wall, such that said panel is easily attached and removed from the basin wall.

Another objective is to have a panel for increasing the vertical extension of a basin wall to protect a person's torso from splashing liquid having a panel which acts as a shield for the torso by extending vertically beyond the basin wall. The panel is maintained between the torso and the basin, thereby allowing said person to reach around the panel into said basin.

The panel has a bottom detachably connected to a base and the base having at least two suction cups on one side and the suction cups attaching the base to the basin wall. The panel is easily attached and removed from the base. The panel would also have an aperture to hang the panel from when it is removed from the basin.

The panel is made of any one of the following materials: high-density polyethylene; acrylonitrile butadiene styrene; low-density polyethylene; polypropylene or polyvinyl chloride. The panel wherein the height of the panel is between 5 to 12 inches; the width of the panel is between 7.5 to 9 inches; and the thickness of the panel is between 0.020 to 0.062 mils.

The panel is made of a flexible plastic material and folds over itself and attaches to itself, such that the panel is still attached to the sink and stores out of the way.

In another objective the panel folds over itself by having two indents at a bottom edge of the panel having a protrusion tab between the two indents. An aperture is located near the top of the panel and when the panel folds over itself the aperture is hooked onto said protrusion tab and holds the panel in a folded over configuration.

Another objective has the panel fold over itself by having a protrusion extension tab extending from a bottom edge of the panel, and an aperture is located near the top of the panel and when the panel folds over itself the aperture is hooked onto the protrusion extension tab and holds the panel in a folded over configuration.

In yet another objective the panel is shaped as a dome side to side when in an unfolded upright position. One way to create this dome is to have the two suction cups having stems that are first placed through keyway apertures in a bar and then the suction cups stems are placed through keyway apertures in bottom part of the panel.

The two suction cups are secured to a smaller section of both sets of keyway apertures and dome side to side of the panel is maintained by the suction cups placement having a narrower configuration than the distance between keyway apertures in the panel. The bar keeps the suction cups in proper narrower configuration.

The side to side dome can also be maintained by two suction cups placed at the outside front bottom of said panel and have stems of equal height dimension. A third suction cup is placed on the inside front bottom between said two suction cups and has a stem longer than the dimension of the two suction cups stem.

In another objective there are three suction cups on a front bottom side of the panel and these suction cups have stems that are first positioned through corresponding apertures in a base and after suction cups stems are positioned through the base, the suction cup stems are positioned through corresponding apertures in the bottom of said panel. The panel is removable from suction cup stems, such that the base and suction cups stay attached to a basin and the panel is removable and stored by hanging from an aperture on the top of said panel.

In another objective the panel is tablet shaped with a flanged rectangular shaped portion at the bottom of the panel. The flanged rectangular shaped portion is a narrower width than the rest of said panel and further comprises a latch aperture.

There is a base having a semicircular recess on an inferior aspect and further comprising a circular latch protrusion and a capture lip on a front side of said base. The panel attaches to base by placing flanged rectangular shaped portion onto said capture lip and latch protrusion, such that latch protrusion of base engages with latch aperture of panel.

The removal of the panel from the base is accomplished by exerting pressure on the exposed panel that is below the semicircular recess which disengages the latch aperture from the latch protrusion and releases the panel from the base. The panel further comprising a contour area at the top of the panel.

In another objective, the panel has a butterfly hinged area to fold the panel and the butterfly hinged area causes the panel to invert in an upright position. This butterfly hinged area is formed in one of the following ways: either butterfly hinged area is vacuum formed; or butterfly hinged area is made of a rubber material and the rest of the panel is any plastic material.

In yet another objective an additional suction cup is located at the bottom portion or top portion of the panel and on an opposite side of the panel than the two suction cups that attach the panel to the basin. When the panel is folded over the additional suction cup attaches to a folded over portion of said panel to hold the panel in the folded position.

An additional objective of the disclosed technology is the panel shape is oval and has an upper portion and a lower portion with a living hinge and a butterfly hinged between the bottom and top portions used to fold the panel.

In another additional objective, the panel also has a living hinge between an upper section and a bottom section of the panel, and an over center catch which holds the panel in a substantially upright unfolded position when engaged.

In yet another objective a top portion of the panel has a pin protrusion and bottom portion has a corresponding socket, such that when the pin protrusion is placed into the socket the panel is held in a folded position.

A final objective is to keep the panel folded with a top portion of the panel having a hook one inch from the top edge of the panel. When said panel is folded the hook snaps over a bottom edge of the panel holding the panel in a folded position.

In accordance with these and other objectives, which will become apparent hereinafter, the disclosed technology will now be described with particular reference to the drawings.

Figure 1:
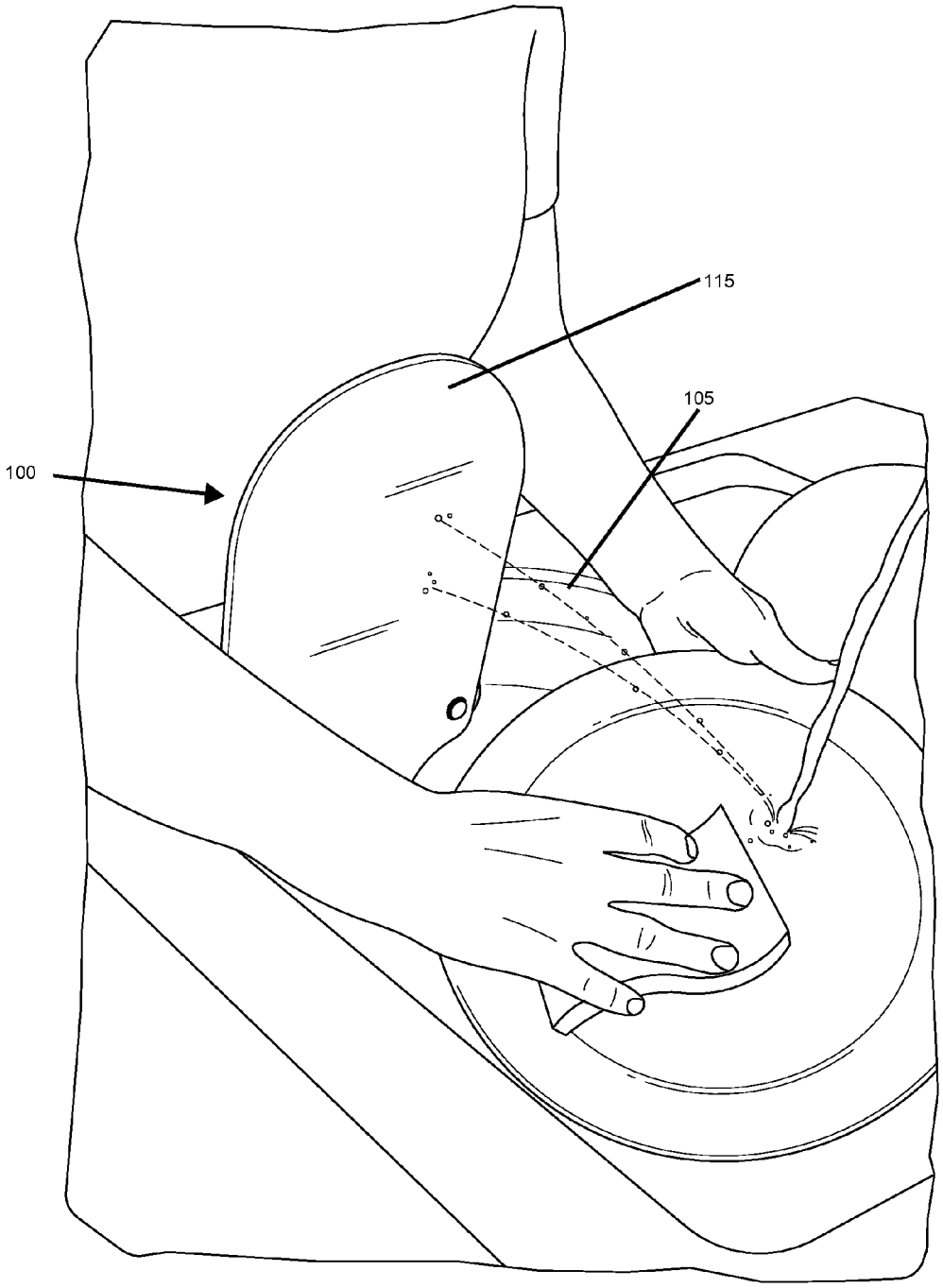
FIG. 1 is a perspective view of a sink splash guard in use while washing dishes.

A better understanding of the disclosed technology will be obtained from the following detailed description of the preferred embodiments, taken in conjunction with the drawings and the attached claims.

DETAILED DESCRIPTION OF EMBODIMENTS OF THE DISCLOSED TECHNOLOGY

The ensuing detailed description provides preferred exemplary embodiments only, and is not intended to limit the scope, applicability, or configuration of the disclosed technology. Rather, the ensuing detailed description of the preferred exemplary embodiments will provide those skilled in the art with an enabling description for implementing the preferred exemplary embodiments of the technology. Various changes may be made in the function and arrangement of elements without departing from the spirit and scope of the disclosed technology, as set forth in the appended claims.

To aid in describing the disclosed technology, directional terms may be used in the specification and claims to describe portions of the present technology (e.g., upper, lower, left, right, etc.). These directional definitions are merely intended to assist in describing and claiming the disclosed technology and are not intended to limit the disclosed technology in any way. In addition, reference numerals that are introduced in the specification in association with a drawing figure may be repeated in one or more subsequent figures without additional description in the specification, in order to provide context for other features.

With reference now to the drawings, a device for a sink splash guard is shown.

Referring to FIG. 1, reference number 100 refers generally to a sink splash guard. This sink splash guard 100 has a panel 115 and is attached to sink or basin 105 and being used for protection from water splashes while a user is washing dishes. The panel 115 is preferably rectangular, tablet or oval shaped.

Figure 2:
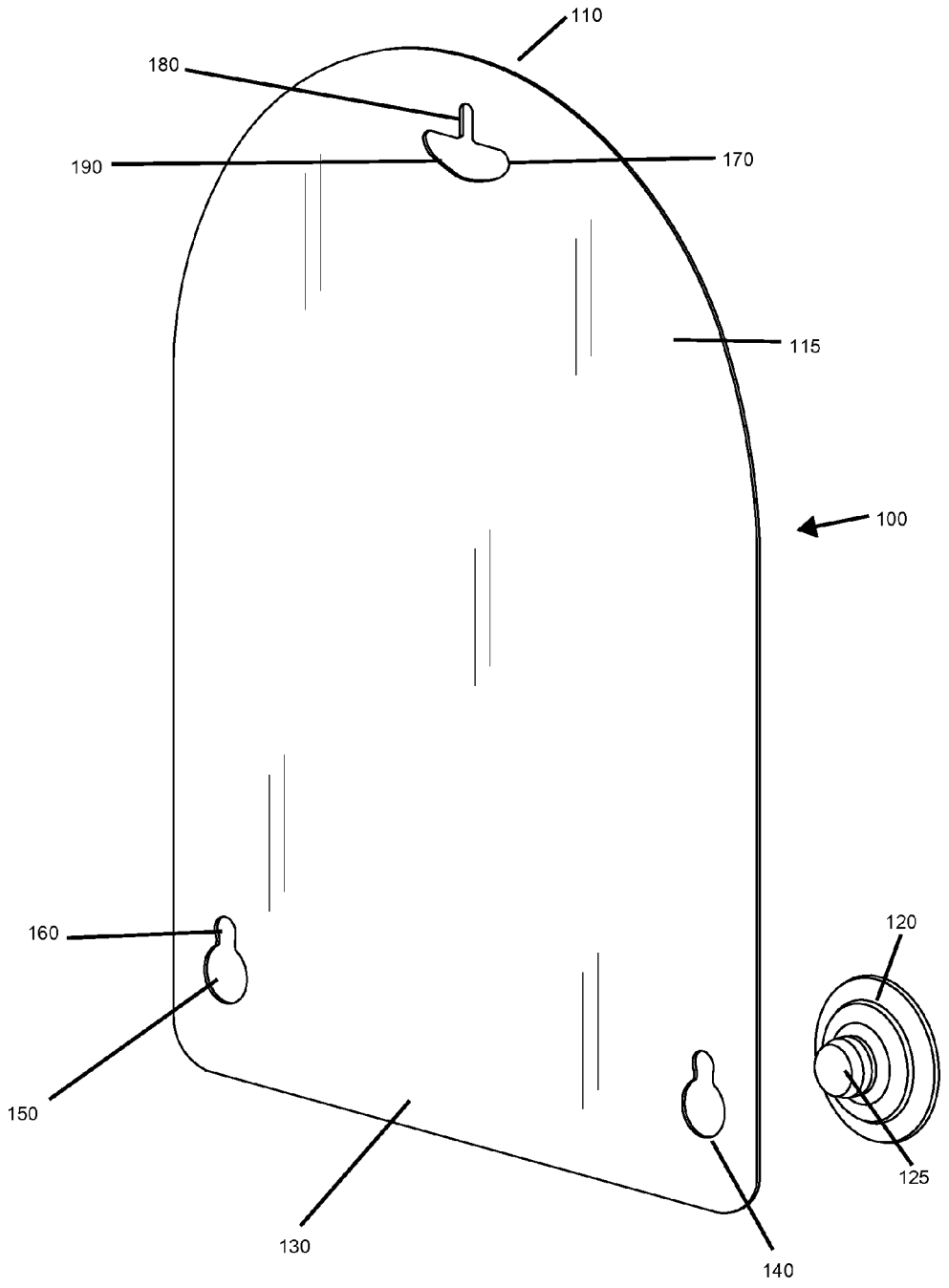
FIG. 2 shows a perspective view from the back of the first embodiment of a sink splash guard with suction cups not yet attached to the sink splash guard.
Figure 3:
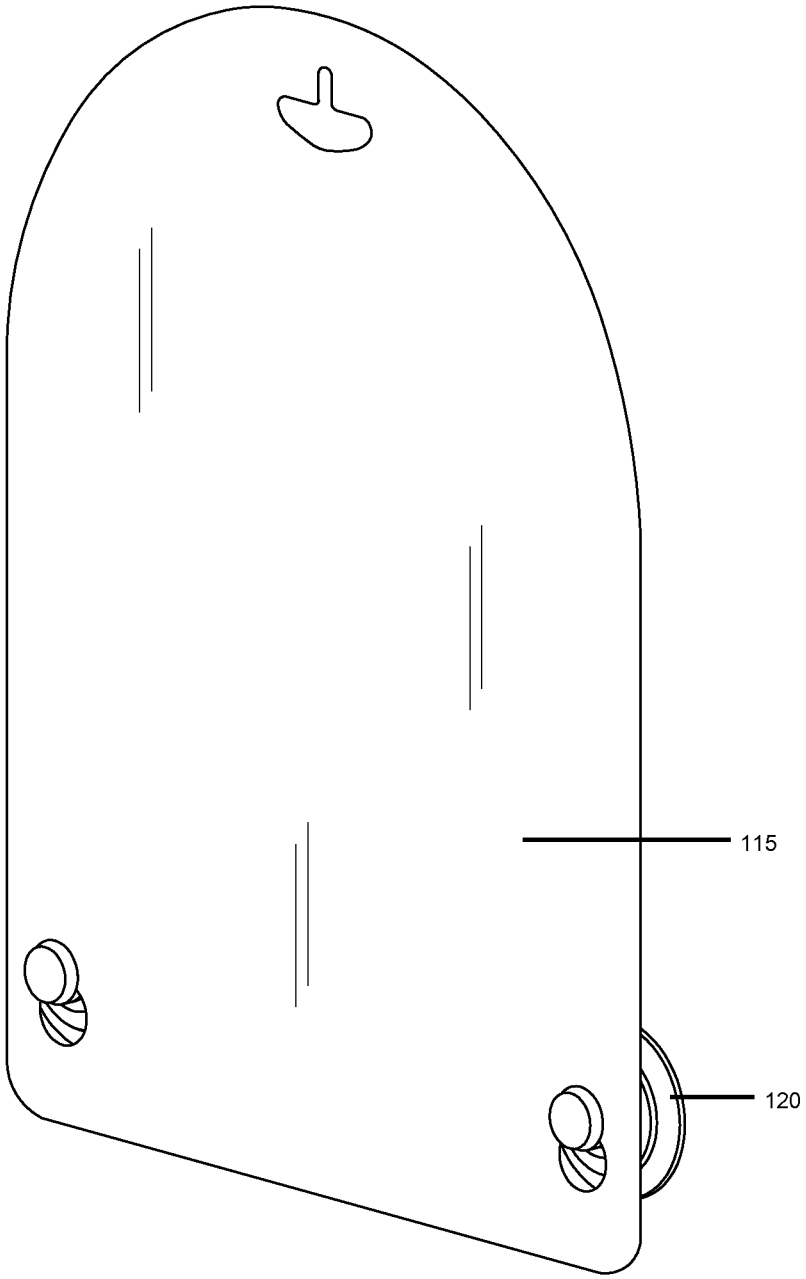
FIG. 3 shows a perspective view from the back of a first embodiment of the sink splash guard with the suction cups attached.

FIG. 2 shows the sink splash guard 100 that is a tablet shaped panel 115. Panel 115 has a top portion 110 and a bottom portion 130. FIG. 3 shows a plurality of suction cups 120 attached to the bottom section 130 of the panel 115. The suction cups 120 allow the sink splash guard 100 to easily attach to and detach from a sink or basin 105.

Also, in the first embodiment, the suction cups 120 have a mushroom type stem 125 with a narrowed groove area. The panel 115 further comprises a keyway aperture 140 having a larger section 150 and a narrower section 160. The sink splash guard is preferably made of any pliable plastic known in the art. Preferred materials are high-density polyethylene, acrylonitrile butadiene styrene, low-density polyethylene, polypropylene, polyvinyl chloride (commonly abbreviated PVC). The panel 115 is preferably die-cut from sheet stock. Alternatively, the panels can be made by vacuum forming or injection molding.

The size of the panel 115 varies to any size that works in a kitchen, laundry, utility or bathroom sink. The height of the panel 115 is preferably between 5 to 12 inches. The width of the panel 115 is between 7.5 to 9 inches. The thickness of the panel 115 is between 0.020 to 0.062 mils. The diameter of suction cups 120 are between 1.125 to 2.375 inches but preferably 1.75 inches when at rest. The diameter in use of suction cups 120 are between 1.25 and 2.5 inches and preferably 1.875 inches. Height of mushroom head 125 from top of cup is preferably 0.25 of an inch.

The suction cups 120 attach to the panel 115 by placing the stem 125 of suction cup 120 through keyway apertures 140 larger sections 150 and then lifting and snapping it into the aperture 140 narrower sections 160. Alternatively, the suction cup protrusions are simply pressed into round apertures as seen better in FIG. 13.

Figure 4:
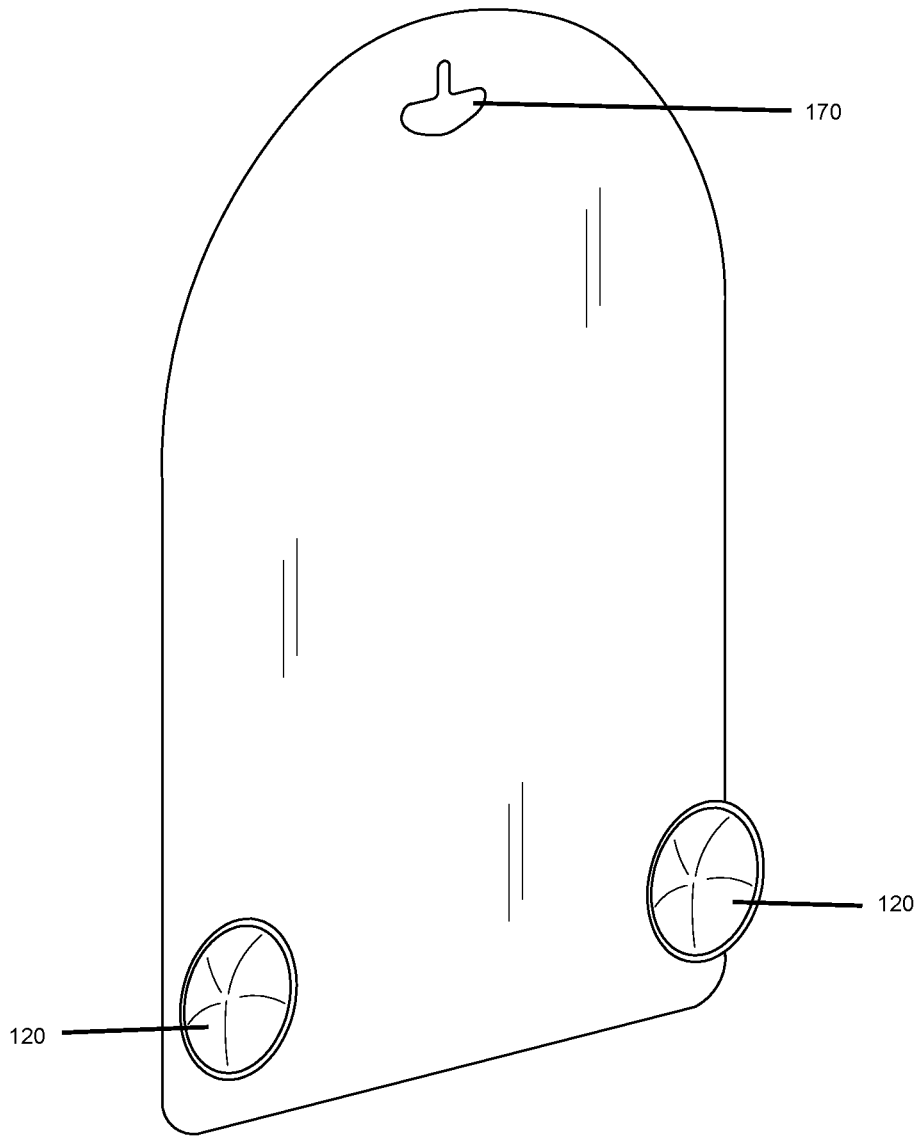
FIG. 4 is a perspective view from the front of a first embodiment of the sink splash guard.

Now referring to FIG. 4, the suction cups 120 once positioned in the keyway aperture 140 are in position to be used to attach the sink splash guard 100 to a sink 105. In this first embodiment the top portion 110 has an aperture 170 also having a narrow section 180 and a larger section 190. The sink splash guard 100 of the first embodiment is removed from a sink one of two ways.

The first option is to release the suction cups 120 from the sink. The second option is to unhook the suction cup protrusion 125 from the keyway aperture 140 and leave the suction cups attached to the sink. After either method of removal, the sink splash guard 100 is preferably hung from a hook or similar item near the sink 105 from aperture 170.

Figure 5:
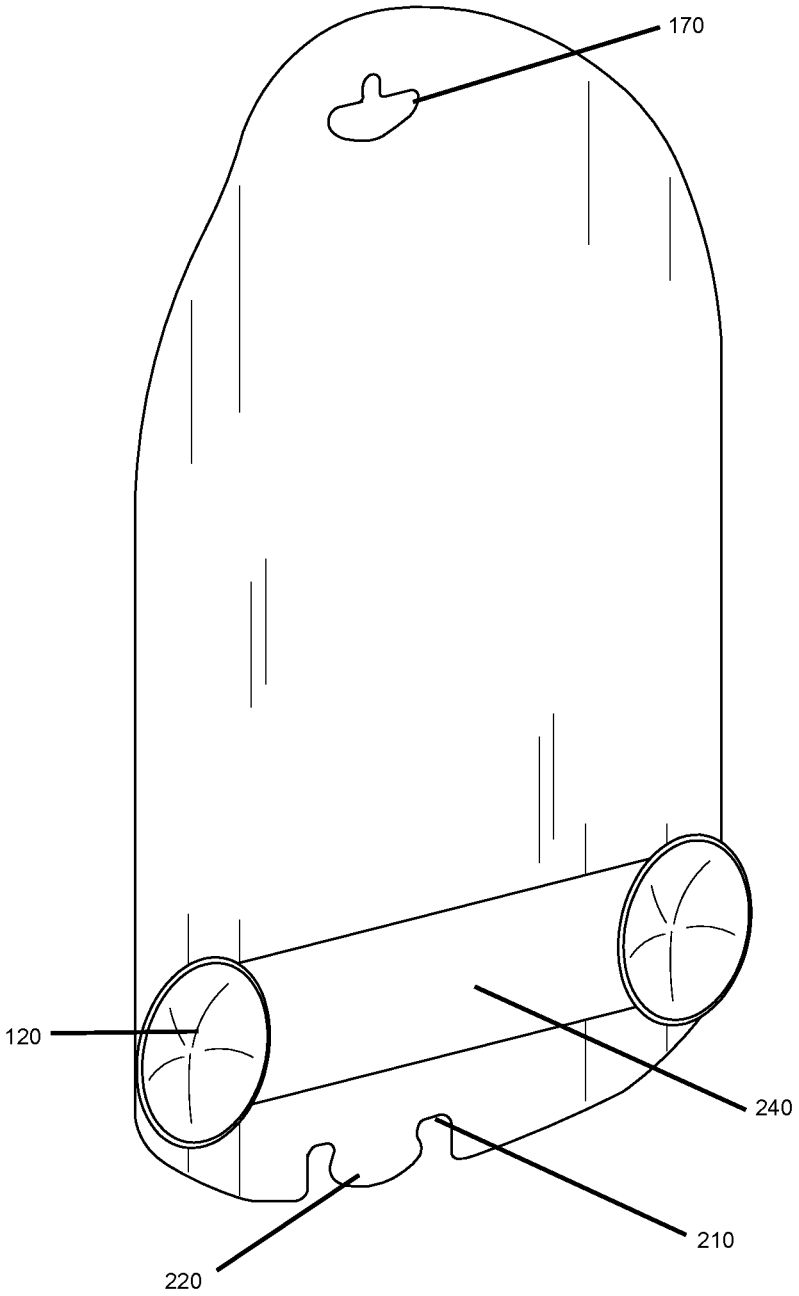
FIG. 5 is a perspective view from the front of a second embodiment of the disclosed technology.
Figure 6:
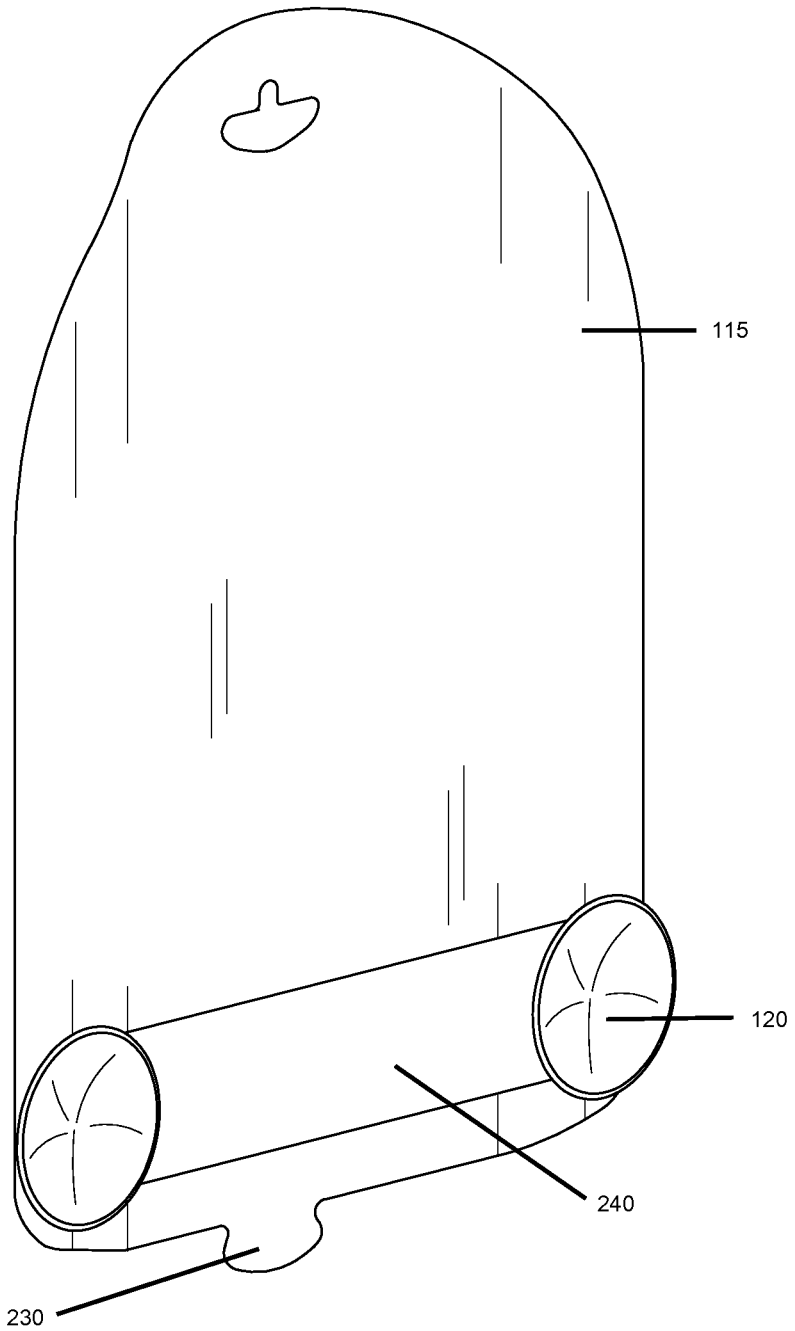
FIG. 6 is a perspective view from the front of a third embodiment of the disclosed technology.

FIG. 5 is a second embodiment of the sink splash guard 100. This embodiment has a bottom edge with two indents 210 creating a protrusion tab 220. FIG. 6 is a third embodiment of the sink splash guard 100 that now has a bottom edge with a protrusion extension tab 230 sticking out. The sink splash guard panel 115 is preferably made of a flexible plastic so that it can fold. In both embodiments two and three, as seen in FIGS. 5 and 6, the panel folds over itself and the top aperture's 170 bigger section 190 hooks onto protrusion tab 220 or protrusion extension tab 230.

Figure 9:
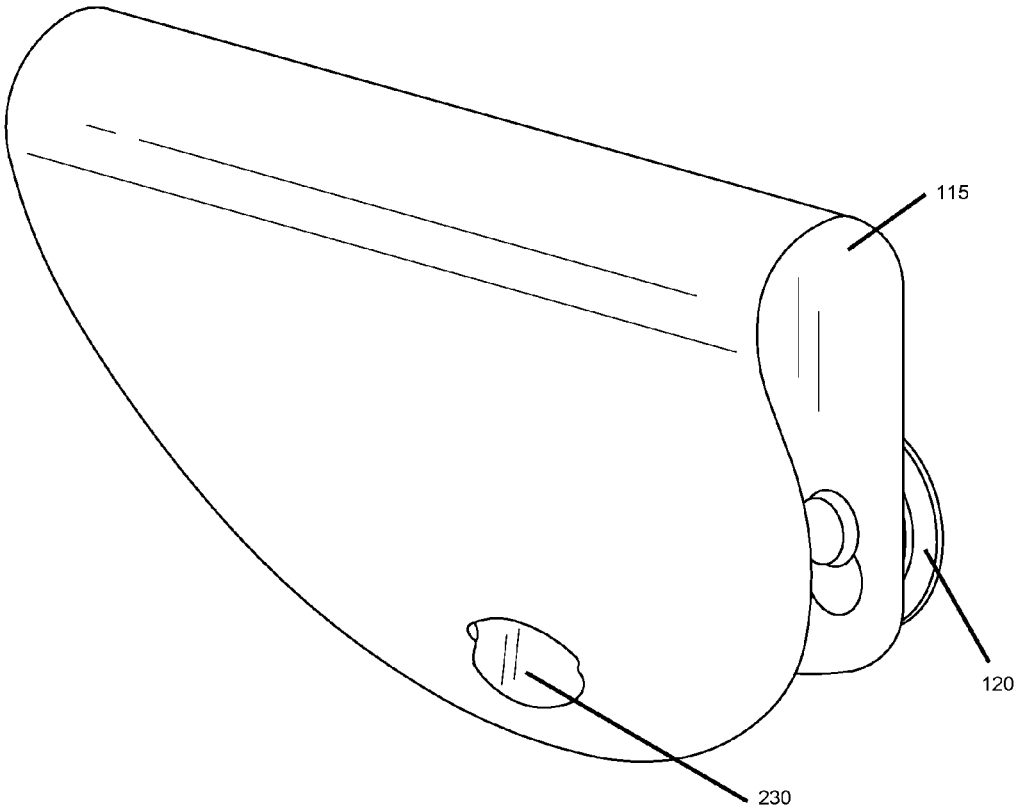
FIG. 9 is a perspective view of a third embodiment of the disclosed technology in a folded over position.

FIG. 9 shows panel 115 of embodiment three folded over itself. The top aperture's 170 bigger section 190 is hooked onto protrusion extension tap 230. Thus, the user has the option to fold the splash guard out of the way while still attached to the sink when it is not being used.

Figure 7:
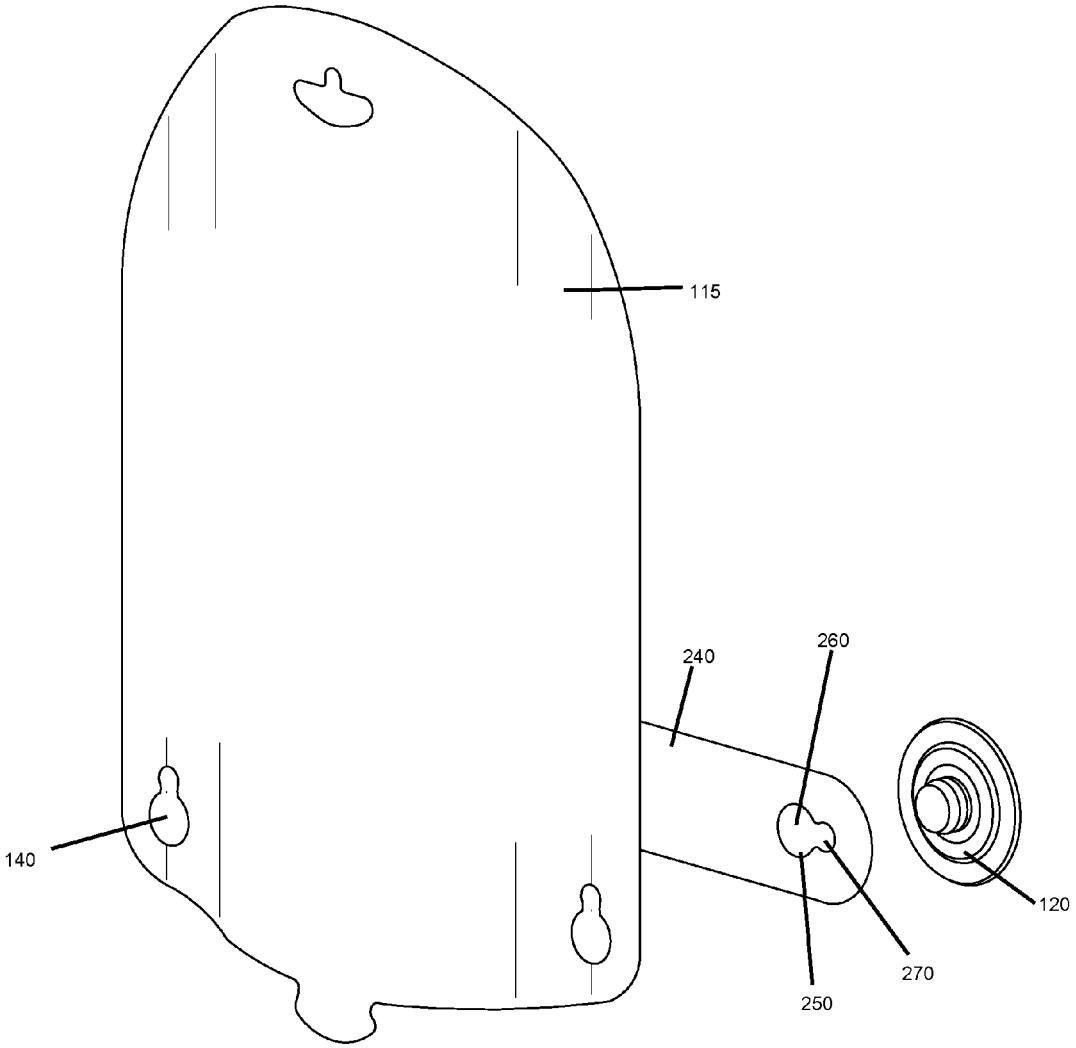
FIG. 7 is a perspective view from the back of a third embodiment of the disclosed technology.

FIG. 7 illustrates that both embodiments two and three further consist of a bar 240 configured between the suction cups 120 and keyway apertures 140. Bar 240 is preferably formed by a die cut process. The bar 240 has sideway keyway apertures 250 with a larger section 260 and narrower section 270. The narrower sections 270 are positioned towards the ends of the bar 240 on either side.

Figure 8:
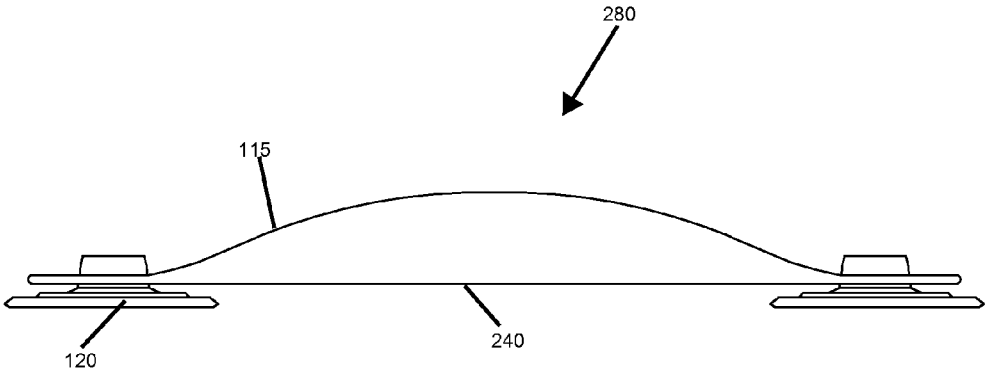
FIG. 8 is a top view of a third embodiment of the disclosed technology.

The panel 115 is forced into a side to side dome 280 as seen best in top view FIG. 8. The suction cup stems 125 are first placed through the side way keyway apertures 250 and secured into narrower sections 270. Then suction cup stems 125 are placed in panel keyways 140 and secured into narrower sections 160. The dome 280 is produced by reducing the distance between the suction cups 120 compared to the distance between the keyway apertures 140. This proper spacing is achieved by utilizing bar 240.

This dome 280 creates residual forces that are great enough to make the panel 115 regain its upright position after panel 115 has been unfolded. Once the suctions cups 120 are connected to the bar 240 and panel 115, the sink splash guard 100 is designed to stay together as a unit. However, the sink splash guard is easily disassembled for better cleaning and then easily re assembled.

Figure 10:
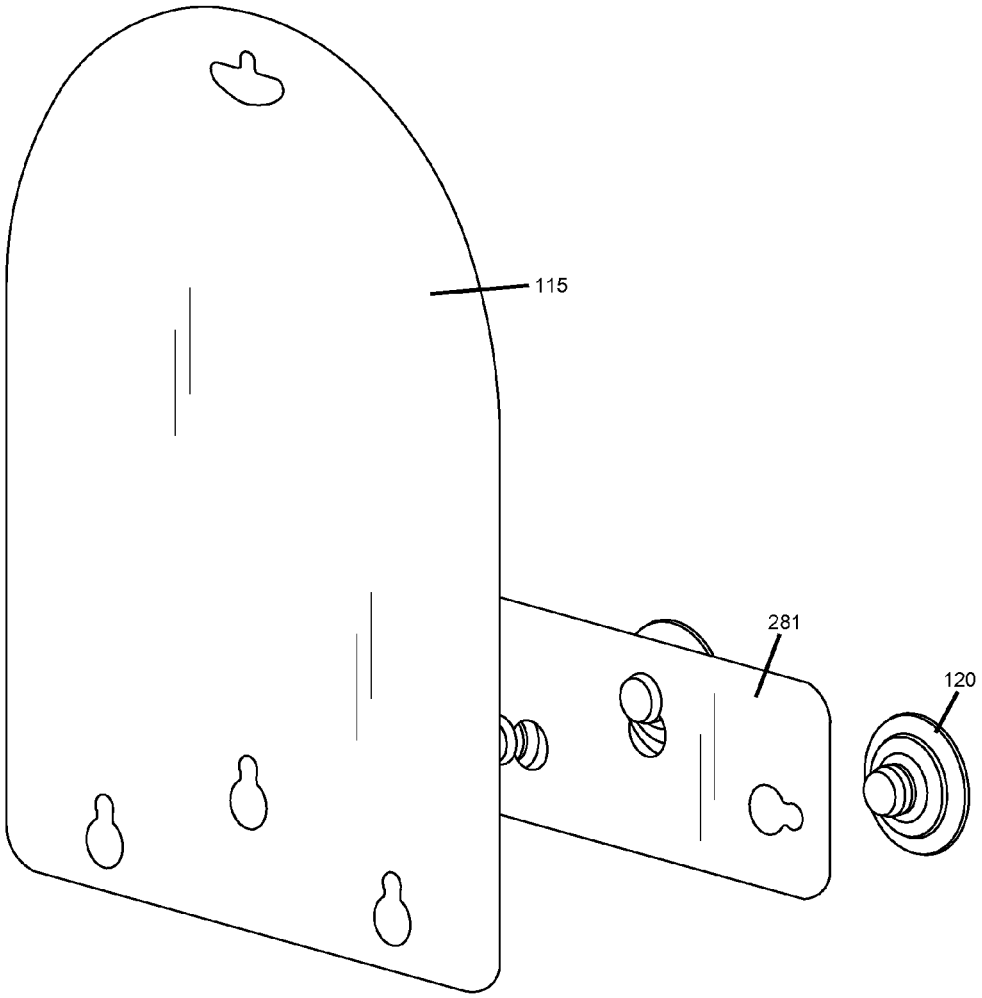
FIG. 10 is a perspective view from the back of a fourth embodiment of the disclosed technology.

FIG. 10 illustrates a fourth embodiment of the current invention. A second type of bar 281 is now between the suction cups 120 and the panel 115. In this embodiment there are now three suction cups 120. Both bar 240 and 281 assure that suction cups 120 are spaced properly. In this embodiment the bar 281 has the ability to stay with the suction cups 120 on the sink. Therefore, panel 115 is stored by removing it from the suction cups 120 and bar 281 and hanging it from aperture 170.

Figure 11:
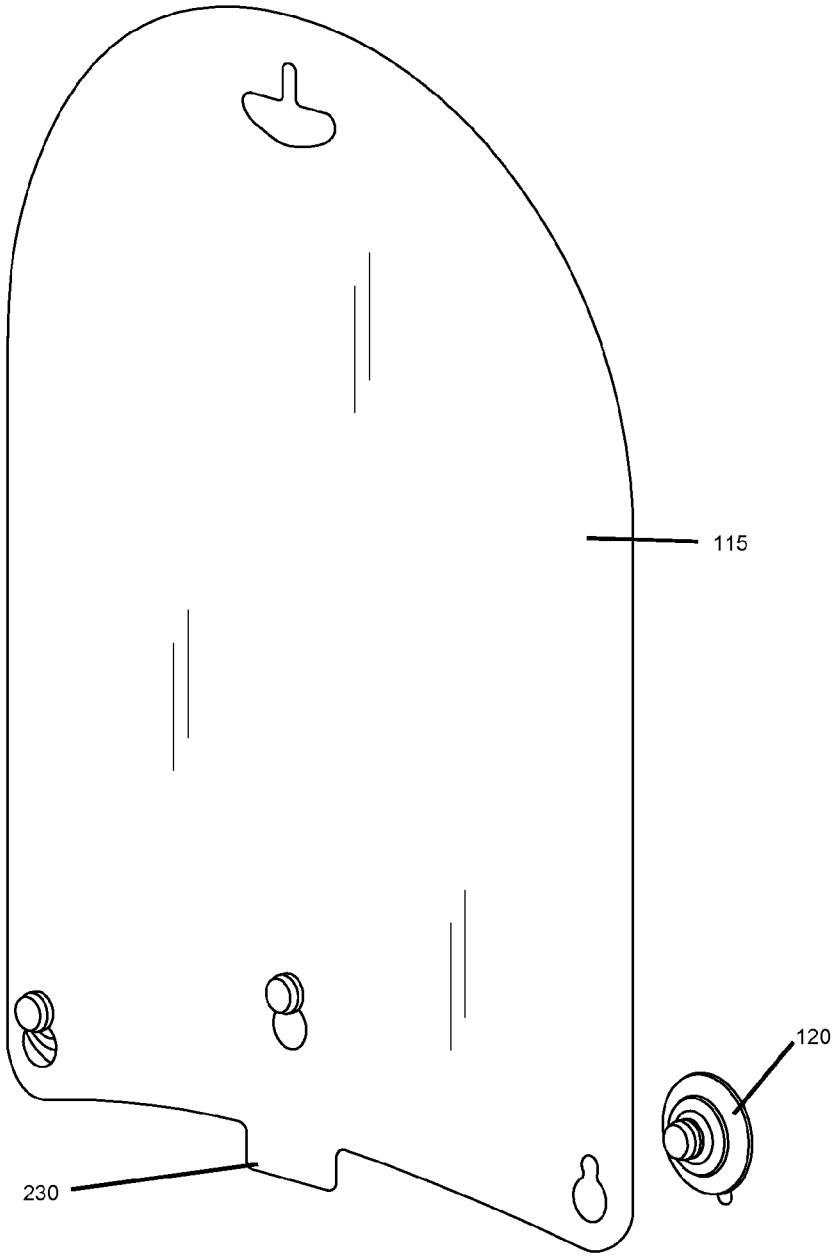
FIG. 11 is a perspective view from the back of a fifth embodiment of the disclosed technology.
Figure 12:
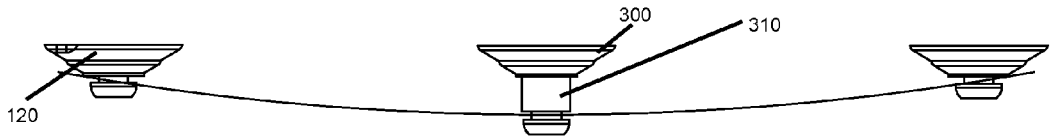
FIG. 12 is a bottom view of a fifth embodiment of the disclosed technology.

FIGS. 11 and 12 are a fifth embodiment of the current technology. This embodiment has a third suction cup 300 positioned at a midway point between the other two suction cups 120. This third suction cup 300 has a longer stem 310 than the two suction cups 120 on either end. Suction cup 300 height of mushroom head extending from top of suction cup is preferably 1 inch. This longer stem 310 is another way to create the dome effect as seen more clearly in FIG. 12. This embodiment also has a slight curve to the bottom edge of the panel 115.

A sixth embodiment of the sink splash guard is seen in FIGS. 13 through 16. Panel 116 is vacuum formed and there is contour 320 to help keep panel 116 stiff. Panel 116 is substantially a tablet shape and further comprises a flange portion 365 at the bottom. This flange portion 365 is rectangular in shape and narrower than the width of panel 116. Panel 116 is detachably connected to a base 330.

Figure 13:
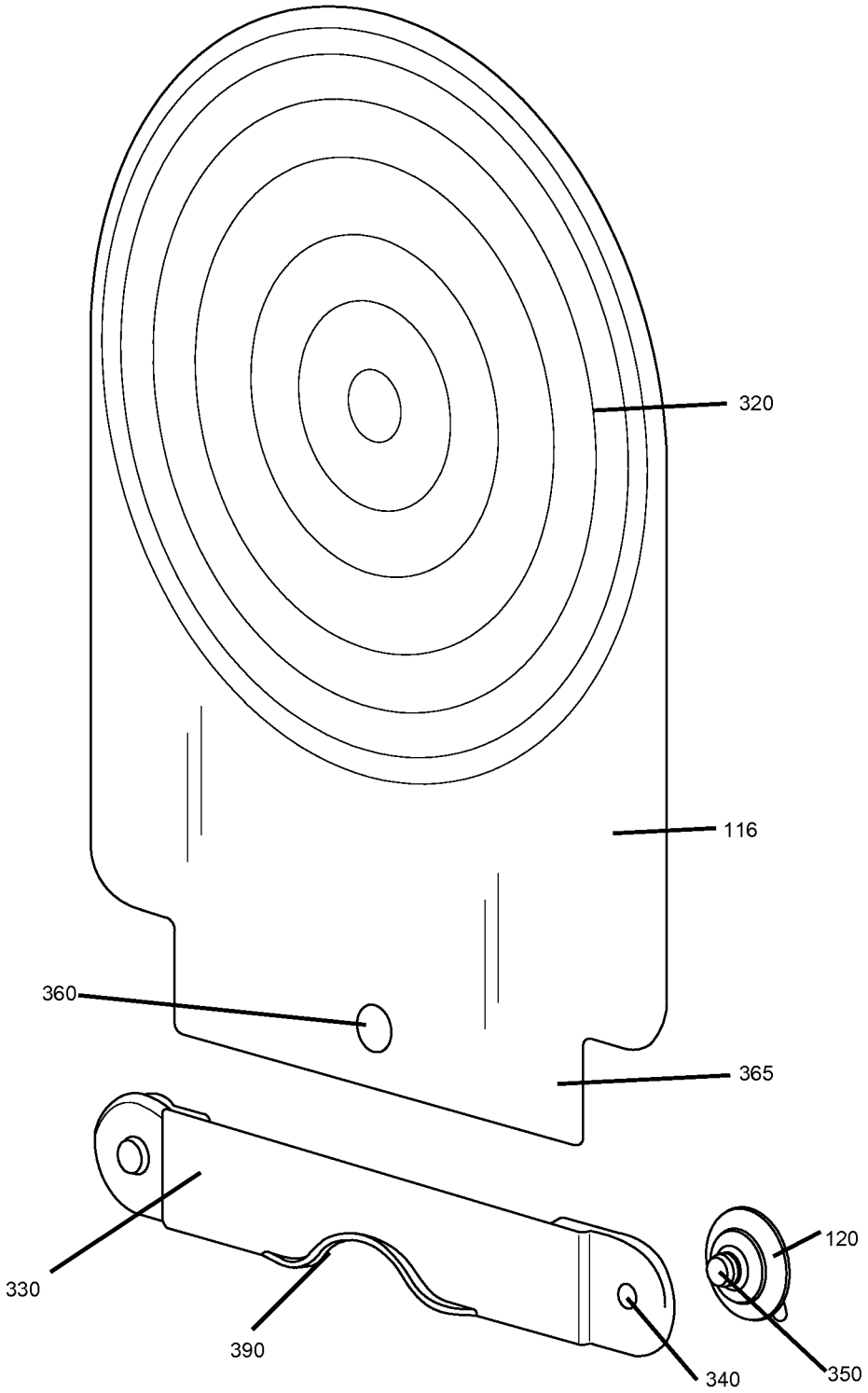
FIG. 13 is a perspective view from the back of a sixth embodiment of the disclosed technology.
Figure 14:
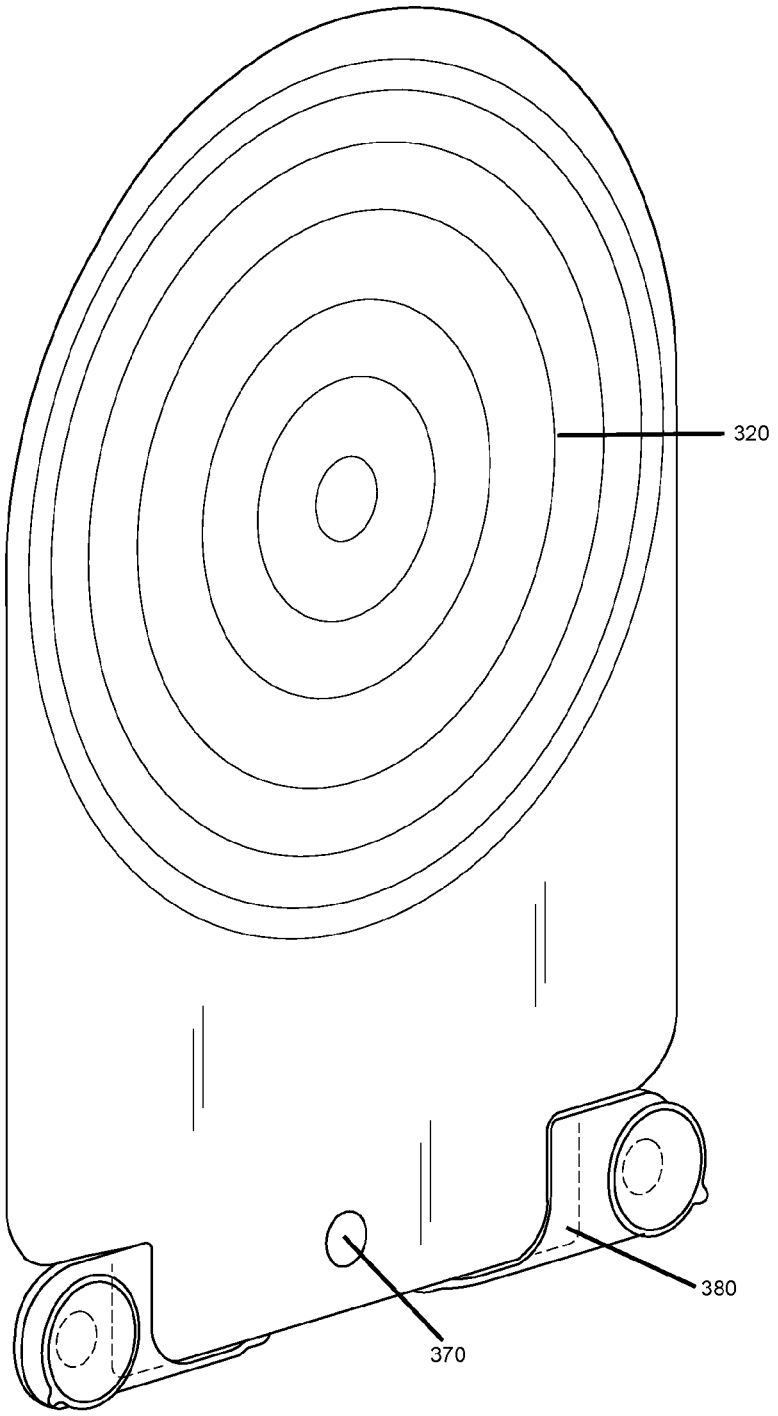
FIG. 14 is a perspective view from the front of a sixth embodiment of the disclosed technology.
Figure 15:
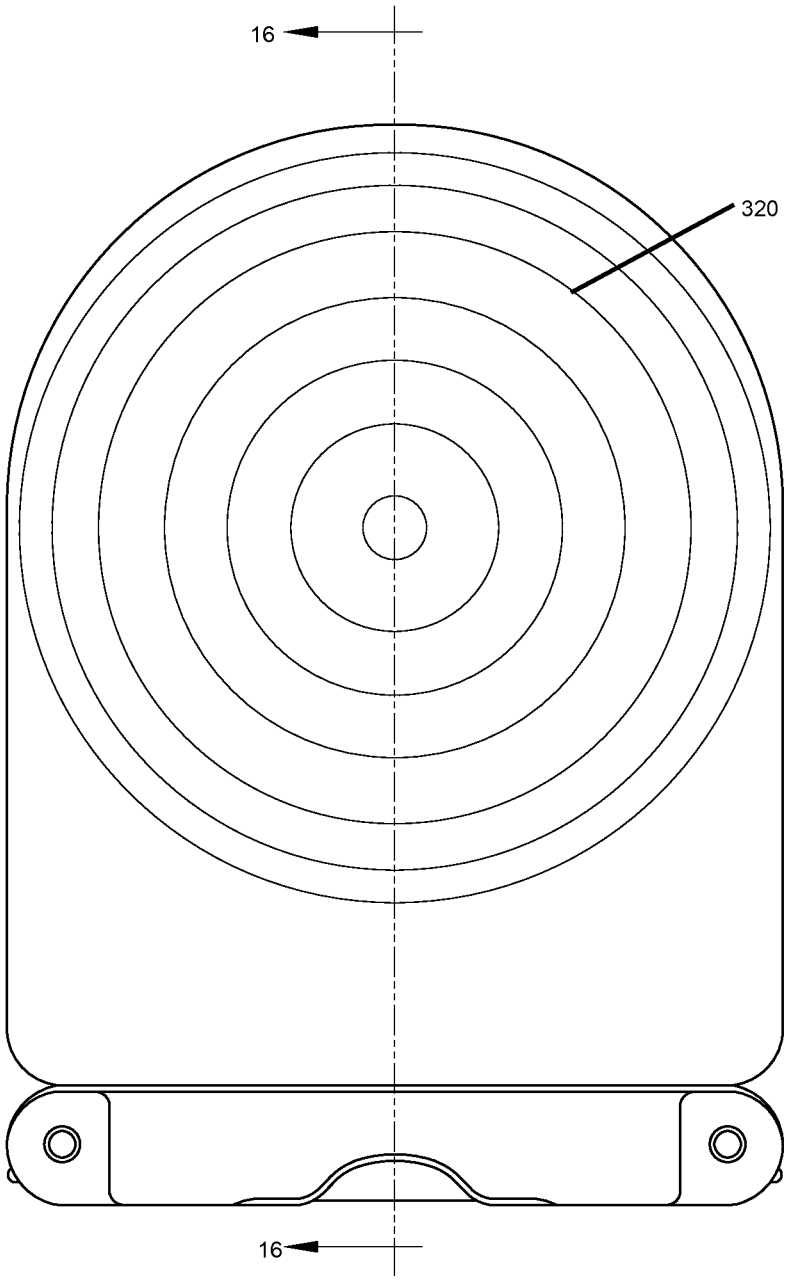
FIG. 15 is a back view of the sixth embodiment of the disclosed technology.
Figure 16:
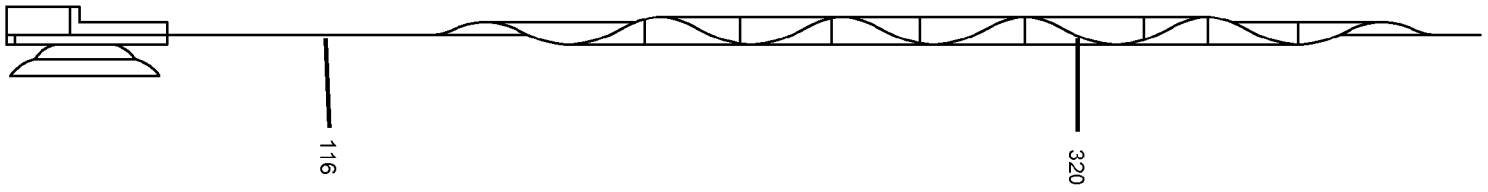
FIG. 16 is a cross sectional view of the sixth embodiment of the disclosed technology.

FIG. 13 shows the panel 116 apart from the base 330. Suction cups 120 have protrusions 350 that are simply pressed into the base through circular apertures 340. The bottom of panel 116 of the sixth embodiment has a latch aperture 360. The middle of base 330 has a circular latch protrusion 370 and a capture lip 380 on the front side of the base 330. Base 330 is preferably made by injection molding.

Panel 116 is placed into the base 330 and the latch protrusion 370 of base goes through the latch aperture 360 of panel 116. Panel 116 also sits on the capture lip 380 of base 330. The base 330 further comprises a semicircular recess 390 on inferior aspect of the base 330.

This recess 390 is used to unlatch panel 116 from base 330. Pressure on the exposed panel 116 that is below the semicircular recess 390 allows the user to disengage the latch aperture 360 off of the latch protrusion 370 and releases the panel 116 from the base 330. Thus, the base 330 remains in the sink and the panel 116 is hung on a hook from latch aperture 360.

Figure 17:
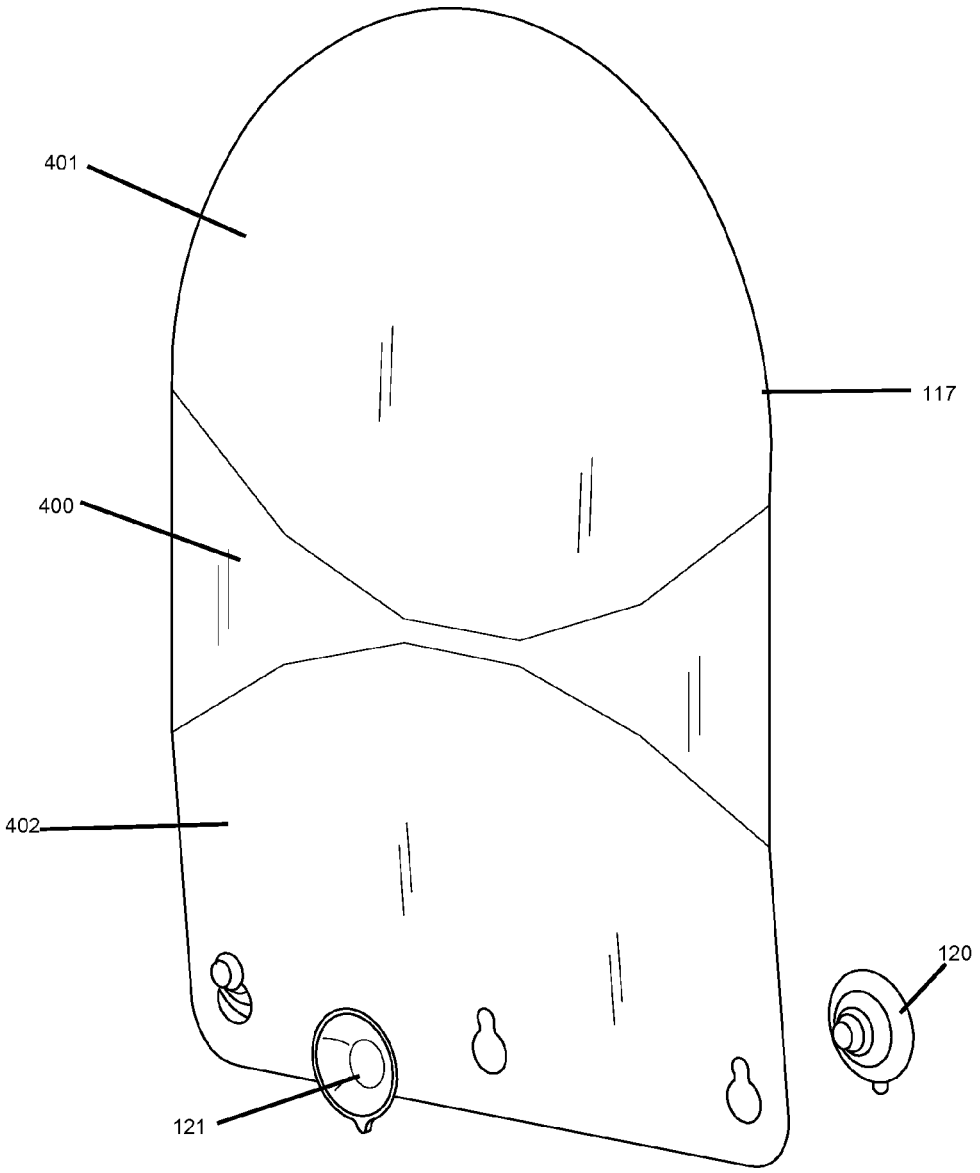
FIG. 17 is a perspective view from the back of the seventh embodiment of the disclosed technology
Figure 18:
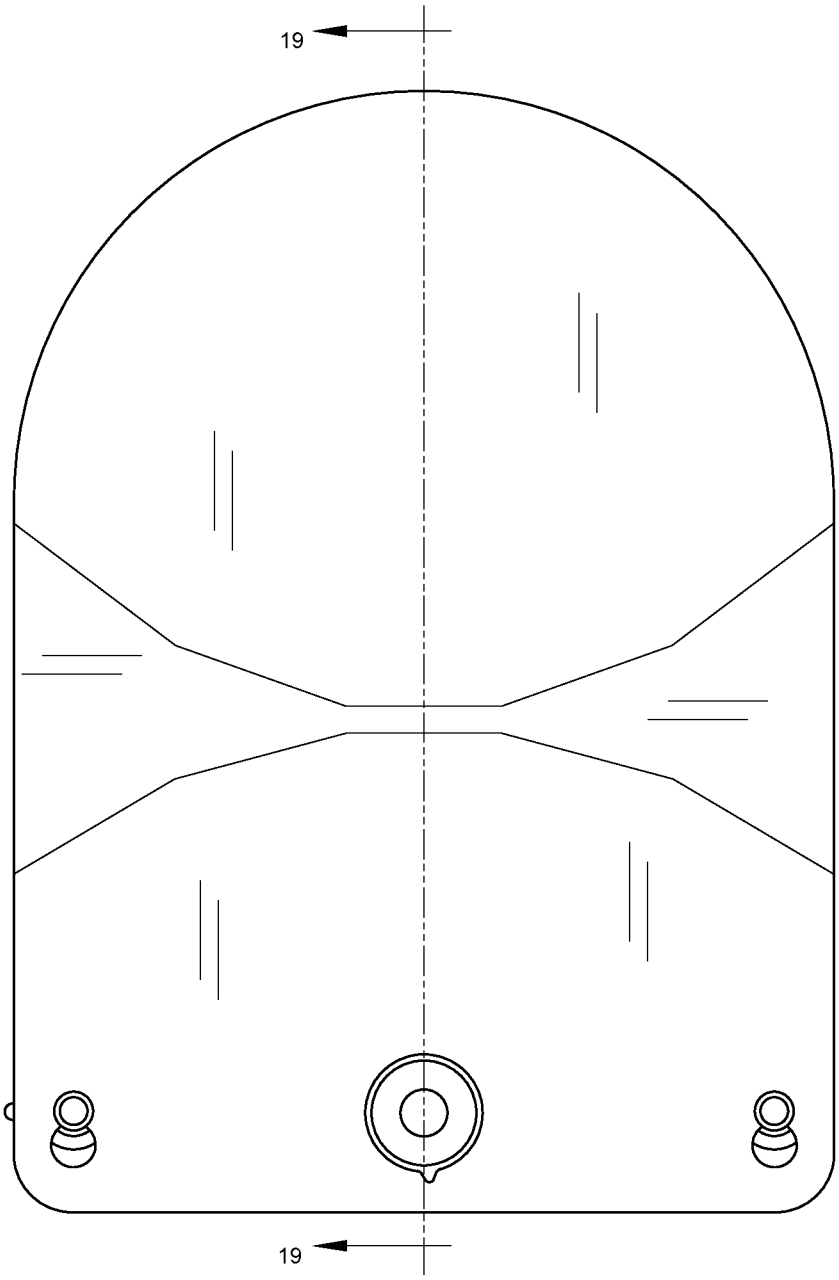
FIG. 18 is a back view of the seventh embodiment of the disclosed technology.
Figure 19:
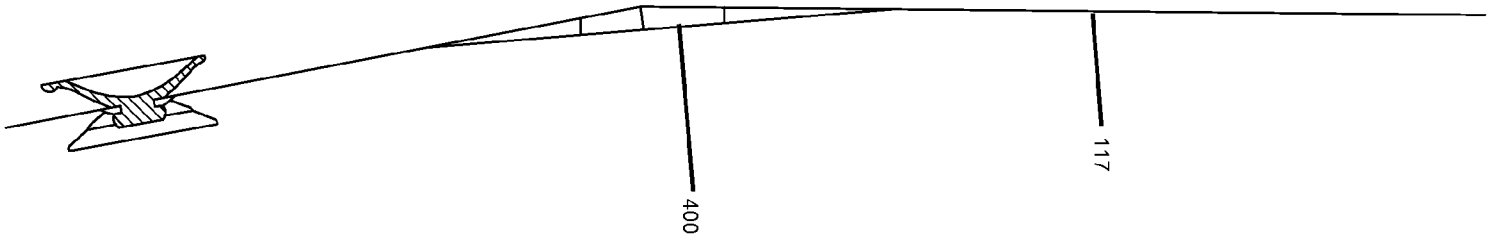
FIG. 19 is a cross sectional view of the seventh embodiment of the disclosed technology.

FIGS. 17 to 19 show a seventh embodiment of the sink splash guard 100. In this embodiment the panel 117 is preferably die cut and vacuum formed. Vacuum formed process is well known in the art of plastics. The mold for this embodiment's vacuum formed process would have three distinct areas. The top part of panel 117 would be one distinct area, a middle distinct area, and a bottom distinct area.

Panel 117 of this embodiment also has butterfly hinged area 400 used to fold the panel 117 over. This butterfly hinged area would be formed by a mold's middle distinct area. This middle distinct area of a mold would be similar to a mountain and thus stretching butterfly hinged area 400 during the vacuum formed process. The butterfly hinged area 400 overcomes folding deformation. The butterfly hinged area 400 height is preferably between 0.25 and 0.5 inches in the center and 4 inches on either side.

The panel 117 further comprises areas below 402 and above 401 the butterfly hinged area 400. These areas 401 and 402 are preferably 5.75 inches at the tallest height. The panel 117 in this embodiment is not flat. Flipping the panel 117 from the folded position to the open position requires the panel 117 contour to invert. The resistance to this inversion generates a force which keeps the panel in the open position. In the open position the area above 401 the butterfly hinge 400 is preferably 190 degrees from the folded over position.

This embodiment further comprises at least three suction cups 120. At least one suction cup 121, preferably the middle suction cup, is placed in the opposite direction to the other suction cups 120. Thus, when panel 117 is folded over, at least one suction cup 121, which is positioned away from the sink wall, attaches to the top half of panel 117. This embodiment gives the option to fold the splash guard out of the way or remove the splash guard 100 when it is not needed.

Figure 20:
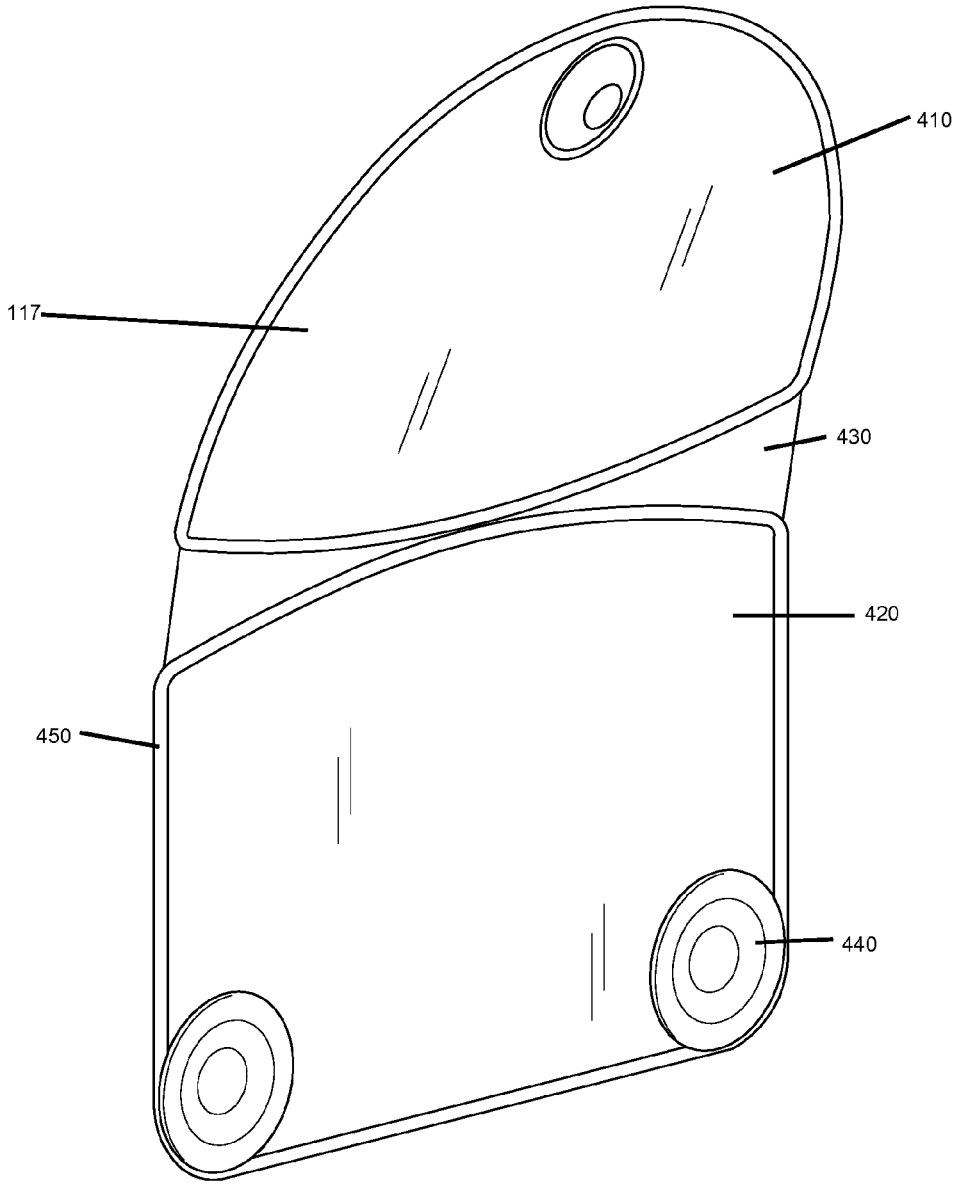
FIG. 20 is a perspective view from the front of an eighth embodiment of the disclosed technology.

FIG. 20 is an eighth embodiment of the sink splash guard 100. This embodiment uses two materials. Panel 117 now has a top section 410 with a height preferable of 4.5 inches. Panel 117 now also has a bottom section 420 with a height preferably of 5.5 inches. Both sections 410 and 420 are made of the normal preferred materials for the panel 117.

Now the butterfly hinge 430 and over molded suction cups 440 are made of over molded silicone or any rubber or similar material known in the art. Edges 450 are also over molded silicone or similar material. The diameter of suction cups 440 are between 1.125 and 2.375 inches but preferably 1.75 inches when at rest. The diameter in use of suction cups 440 are between 1.25 and 2.5 inches and preferably 1.875 inches. The center of butterfly hinge 430 is 0.25 inches to 0.5 inches in height at the mid-point and at its sides is 2 to 3 inches in height. At least one molded suction cup 440 is located at the top portion 410 of the panel 117 and is used to attach to the bottom panel section 420 holding panel 117 in a folded over position.

Figure 21:
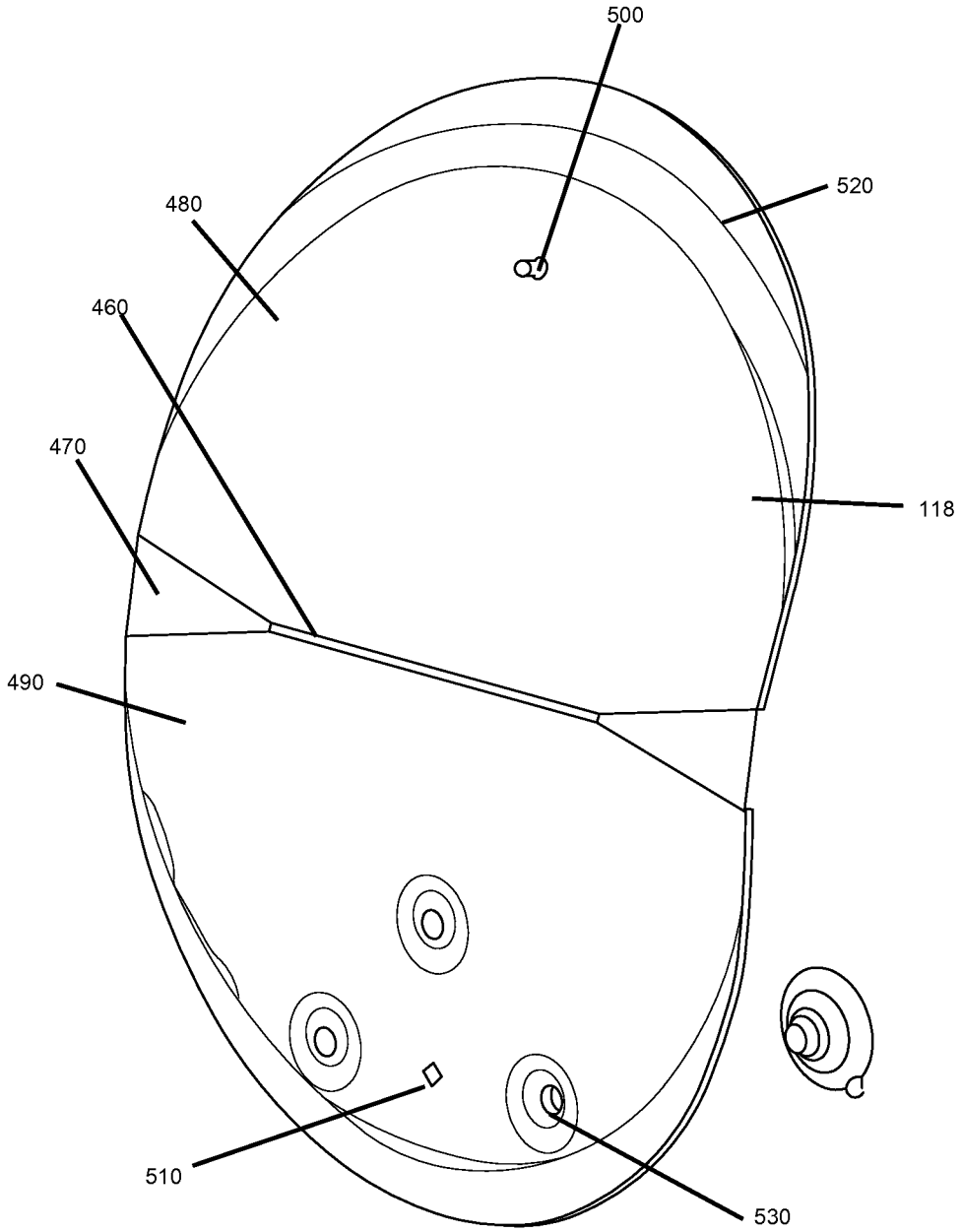
FIG. 21 is a perspective view from the back of a ninth embodiment of the disclosed technology.
Figure 22:
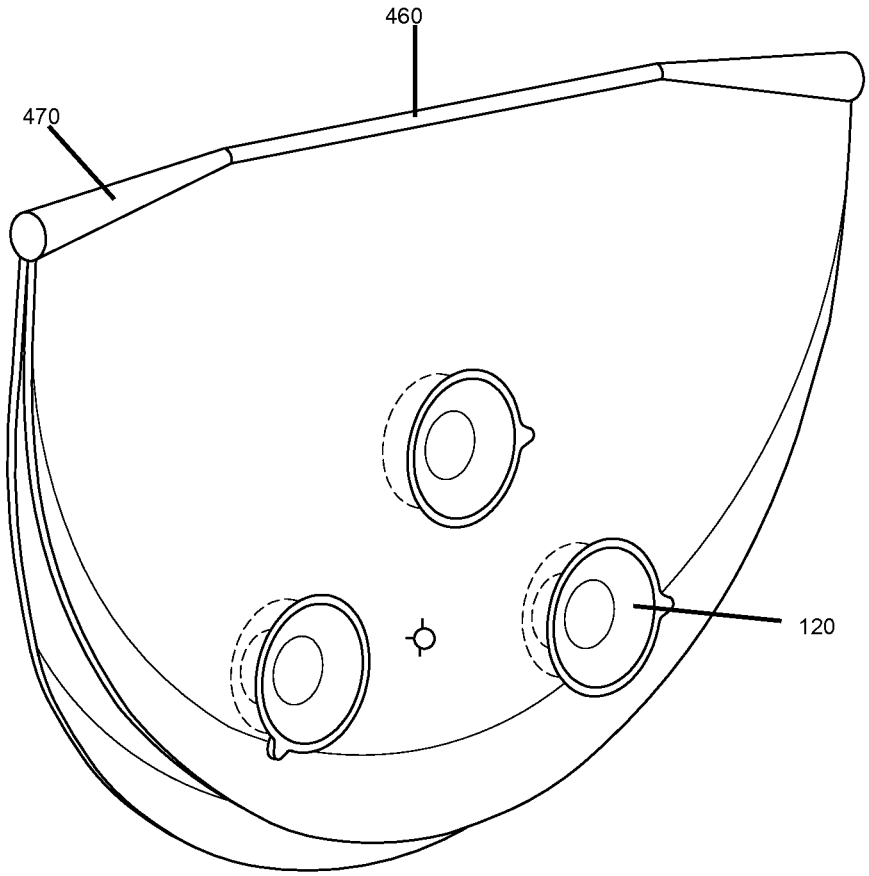
FIG. 22 is a perspective view folded over of a ninth embodiment of the disclosed technology.
Figure 23:
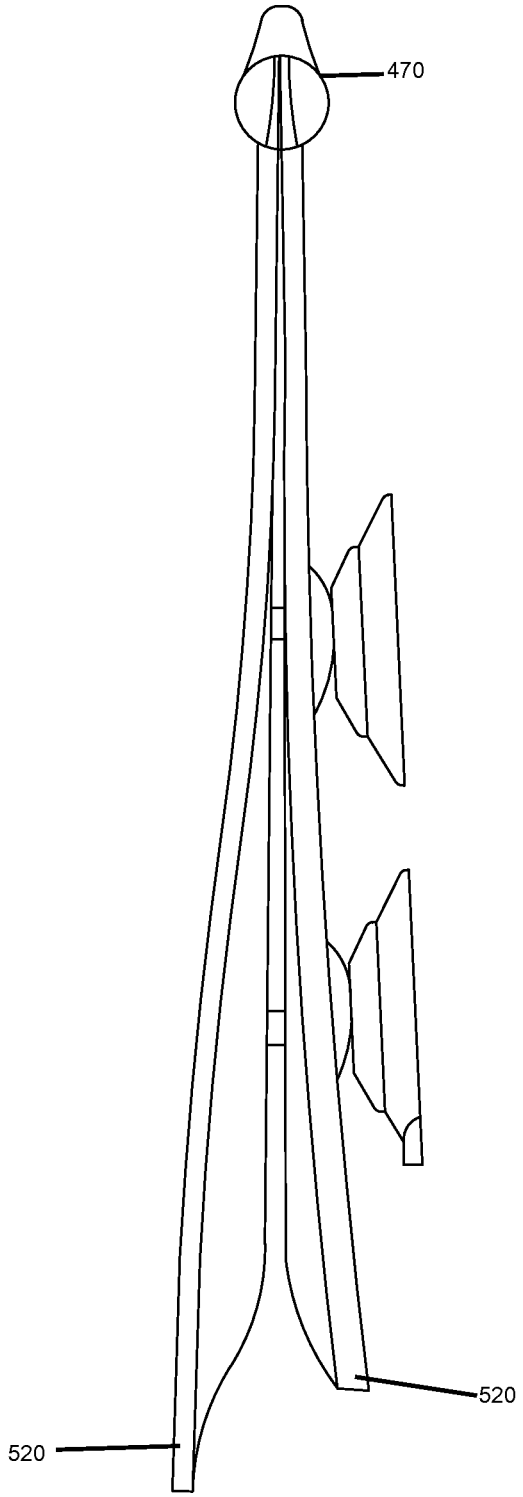
FIG. 23 is a side view folded over of the ninth embodiment of the disclosed technology.
Figure 24:
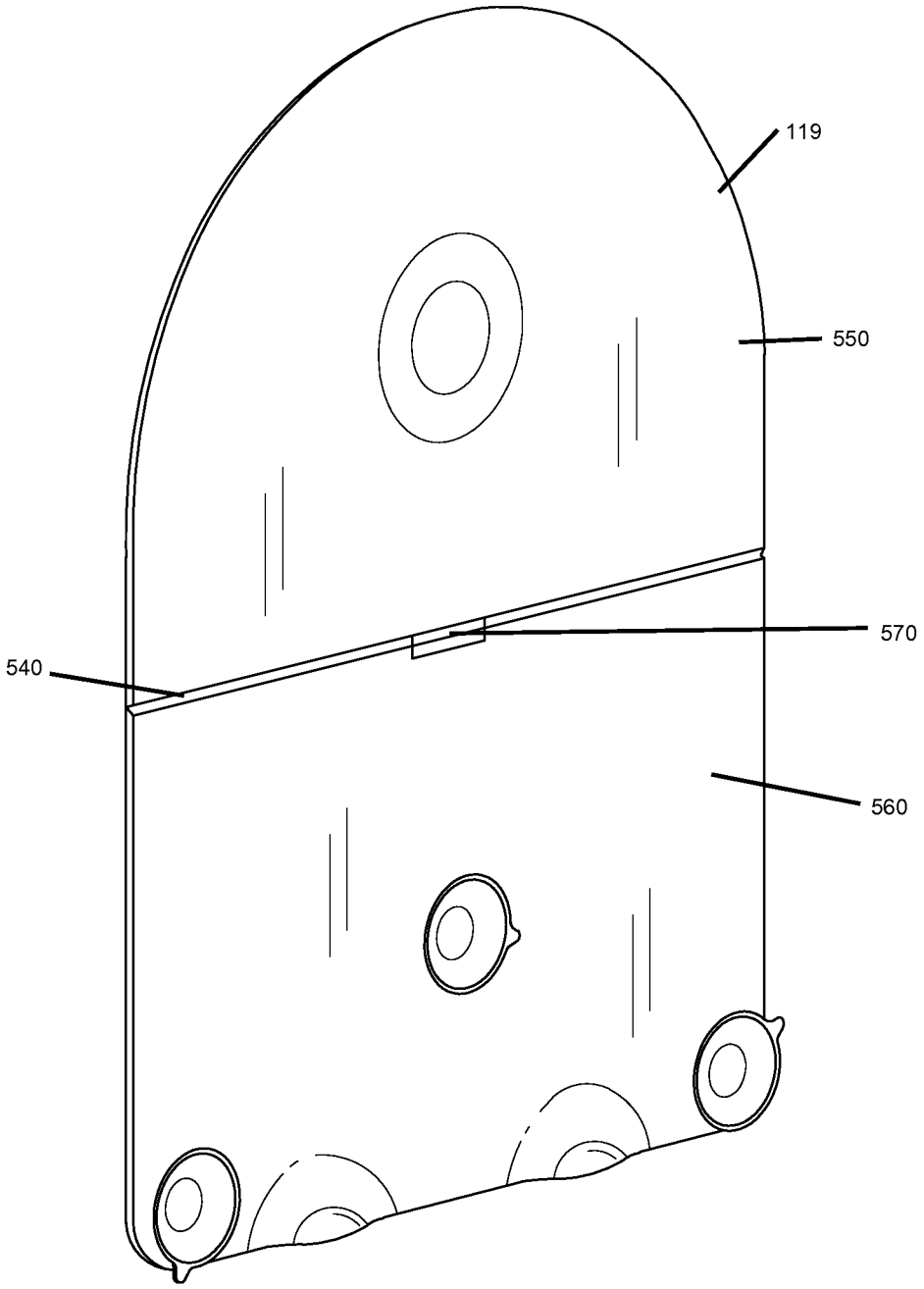
FIG. 24 is a perspective front view of the tenth embodiment of the disclosed technology.
Figure 25:
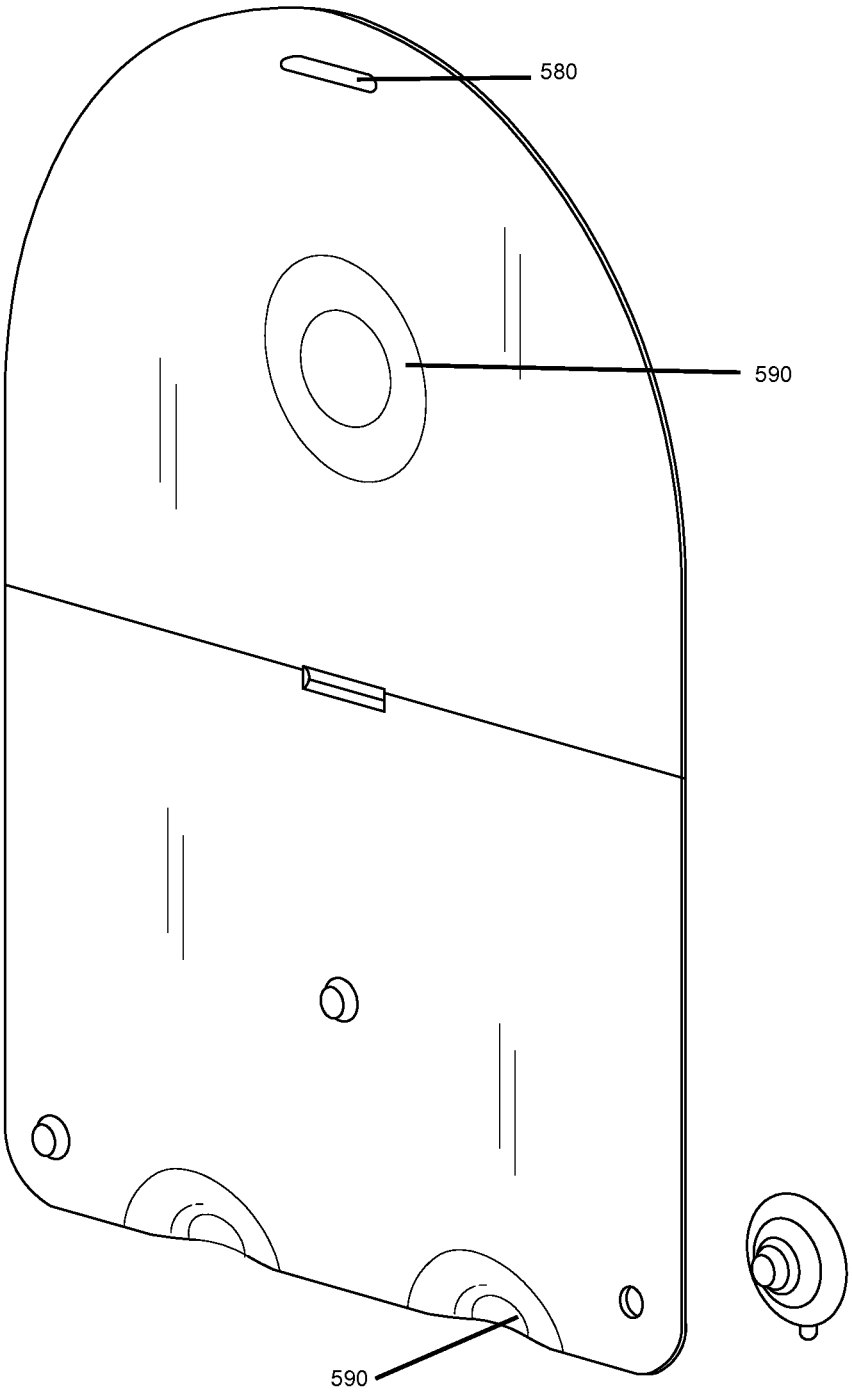
FIG. 25 is a perspective back view of the tenth embodiment of the disclosed technology.

FIGS. 21 to 23 are a ninth embodiment of the sink splash guard. The Panel 118 is now oval in shape and has an upper portion 480 and a lower portion 490. A living hinge 460 is used in conjunction with butterfly hinges 470. This embodiment is preferably produced with injection molding. The upper portion 480 has a pin protrusion 500 which has a corresponding socket 510 on the lower portion 490.

When folded over, the pin protrusion 500 is placed into the socket 510 to hold the panel 118 in a folded position. This ninth embodiment further comprises a lip section 520 on both the bottom edge and top edge. The lip section 520 is preferably a height of 1 inch. This lip section 520 is used to pull open the sink splash guard from the closed position. The suction cup stems 530 are recessed in this embodiment.

FIGS. 24 through 31 are the tenth embodiment of the sink splash guard 100. This embodiment comprises a living hinge 540, an upper section 550 of panel 119 and a bottom section 560. Upper section 550 is preferably 8.5 inches wide and 5.5 inches in height. Bottom section 560 is preferably 8.5 inches wide and 5.5 inches in height. An over center catch 570 holds the panel in the substantially upright unfolded position when engaged.

Figure 29:
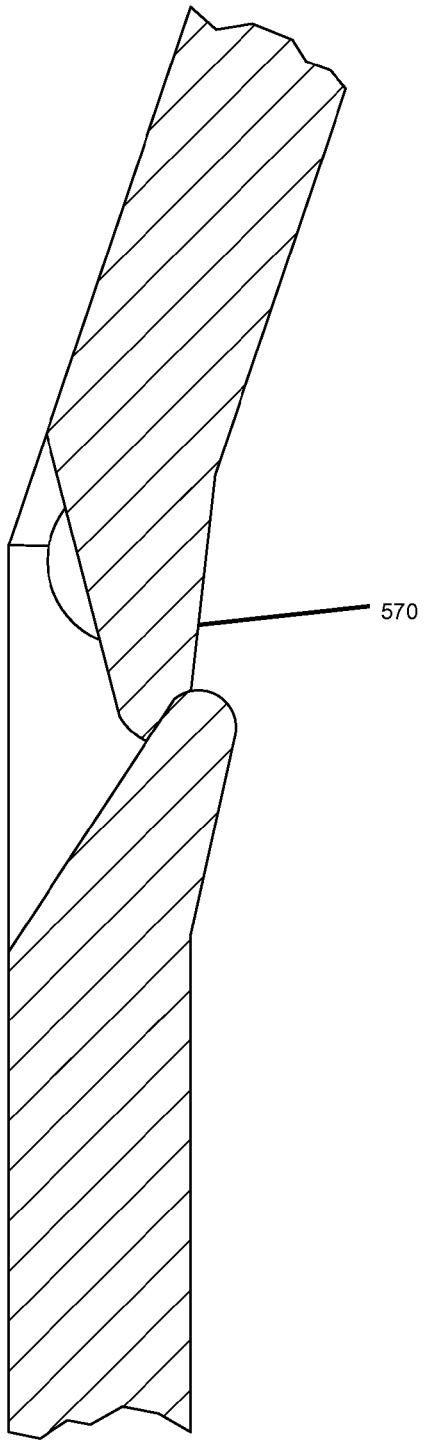
FIG. 29 is a close up cross sectional view of the latch in an open position of the tenth embodiment of the disclosed technology.
Figure 30:
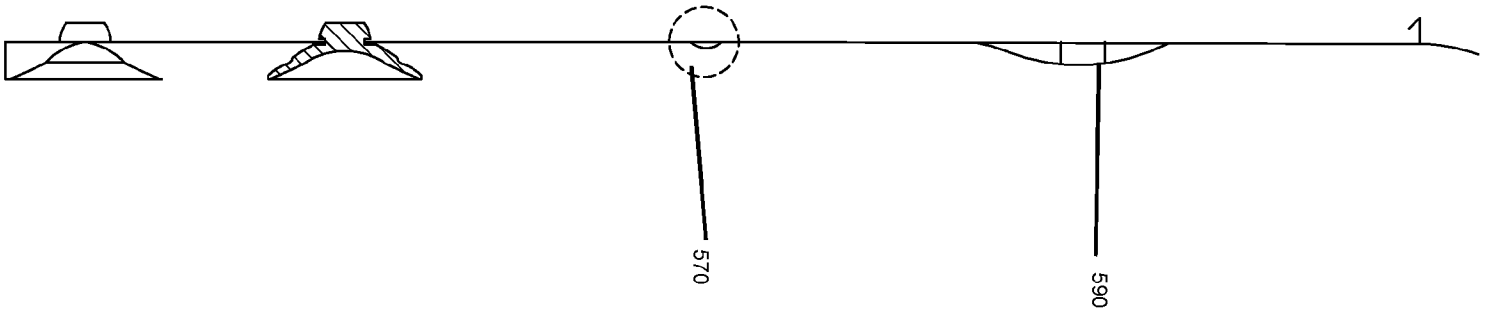
FIG. 30 is a cross sectional view of a latch in a closed position of the tenth embodiment of the disclosed technology.

FIG. 29 shows the detail of the over center catch 570 in an open position, which creates the upright panel 119 position. Top part of catch 570 is engaged behind the bottom part keeping the sink splash guard in an upright position. In an upright position upper section 550 is between 190 to 210 degrees in relation to its folded position.

Figure 26:
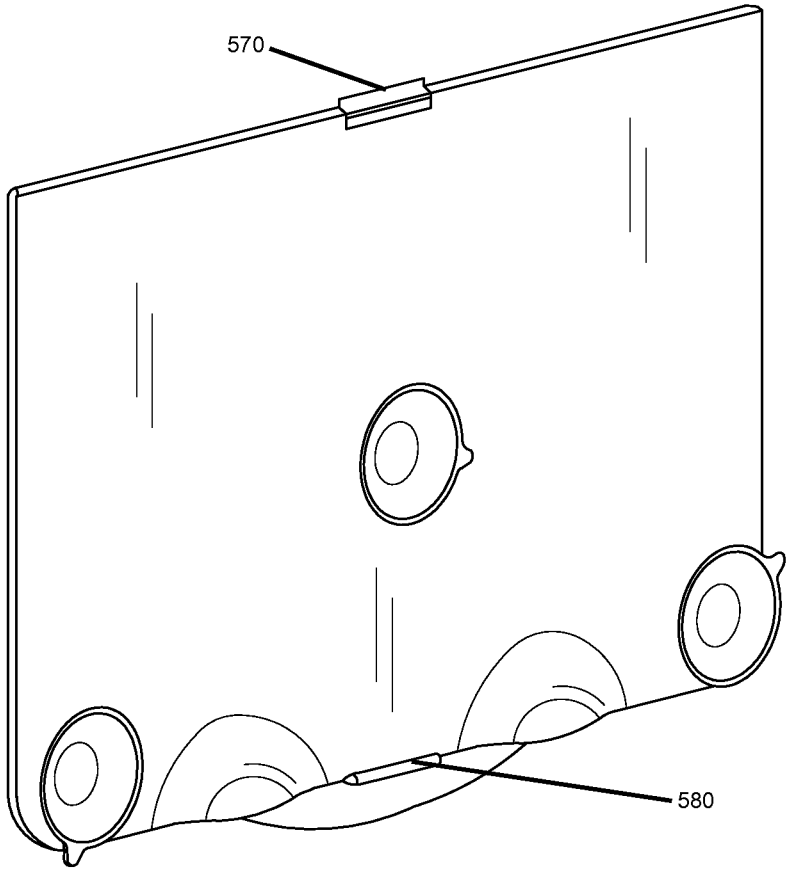
FIG. 26 is a perspective view folded over of the tenth embodiment of the disclosed technology.
Figure 27:
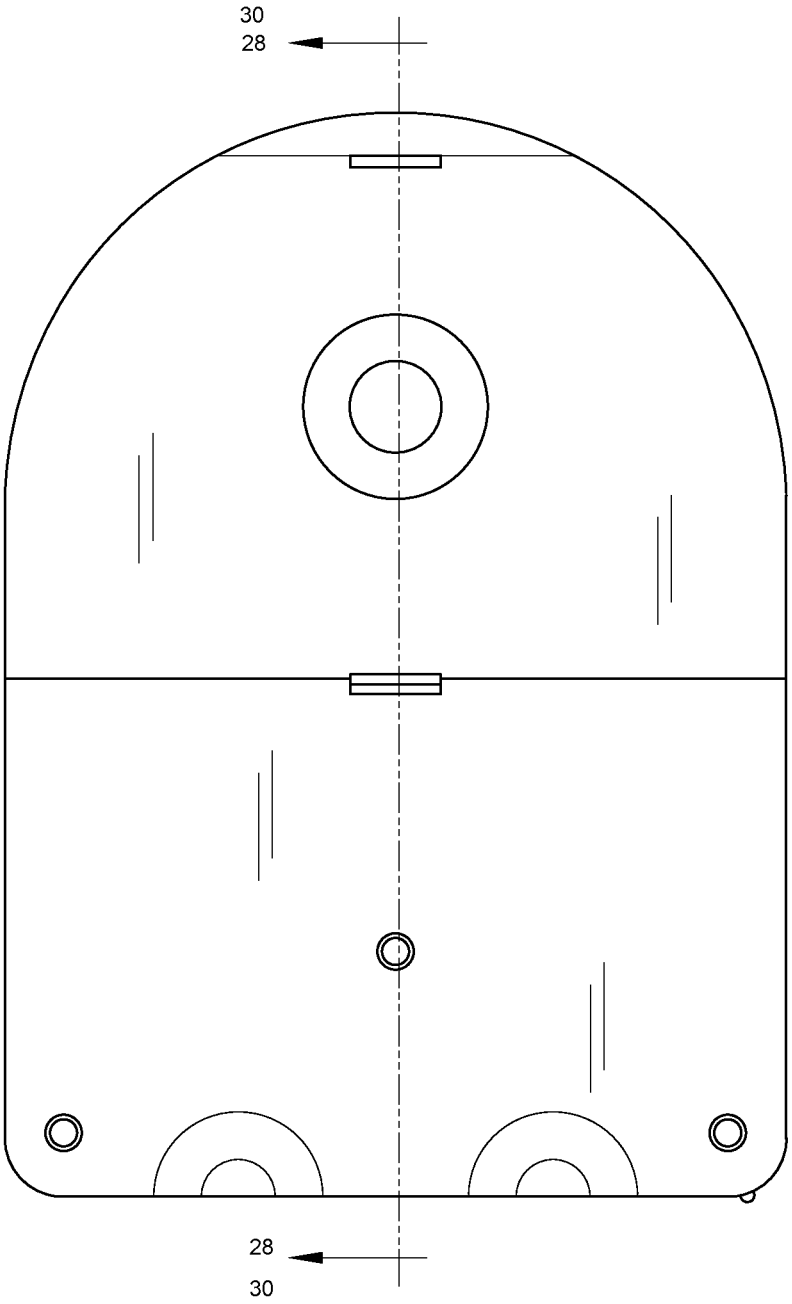
FIG. 27 is a back view of the tenth embodiment of the disclosed technology.
Figure 28:
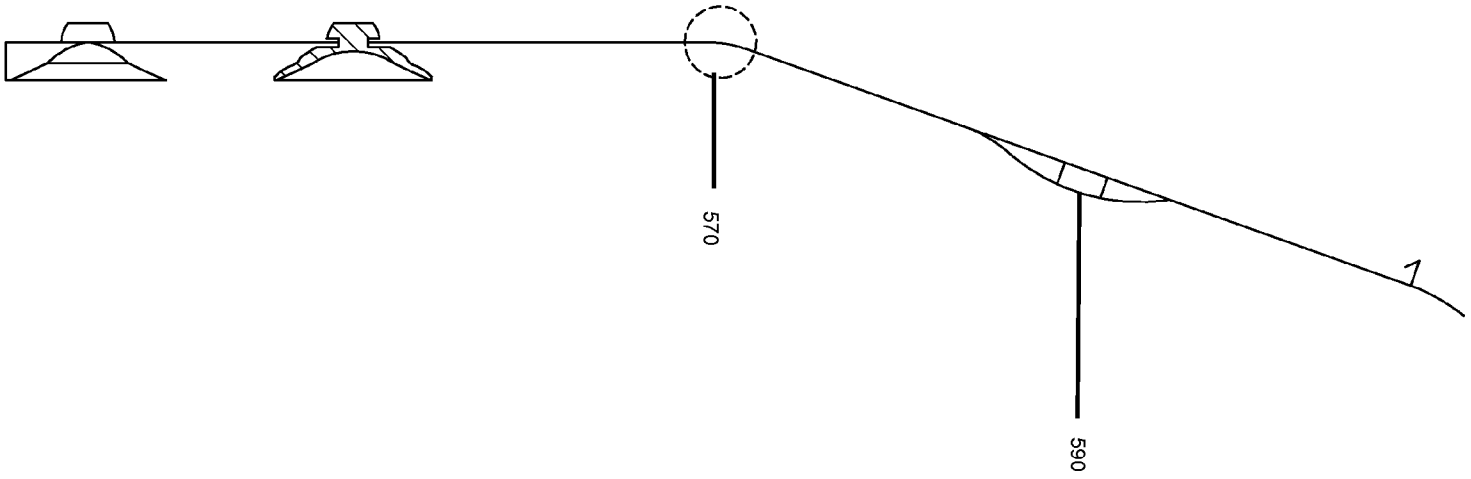
FIG. 28 is a cross sectional view of a latch in an open position of the tenth embodiment of the disclosed technology.
Figure 31:
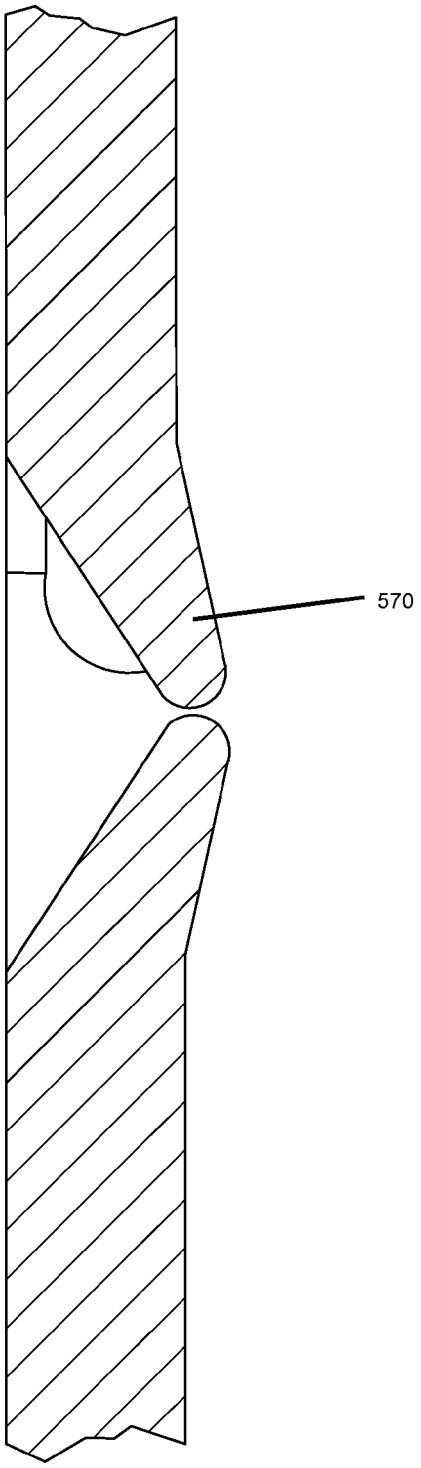
FIG. 31 is a close up cross sectional view of a latch in a closed position of the tenth embodiment of the disclosed technology.

There is a hook 580 preferably 1 inch from the top edge of upper section 550. The hook 580 snaps over the bottom edge to hold the panel 119 in the folded position, as seen in FIG. 26. The panel 119 further comprises indented portions 590 which assures there will be room for suction cup stems 125 when in the folded position. FIG. 31 shows the over center catch detailed in a closed position or more precisely in a position that allows the panel 119 to fold over.

In all the embodiments a design or logo can be positioned on the top front area of the panel 115 to 119. The top front area of the panel is the side of the panel 115 to 119 that faces the people. This design or logo has many options to apply it to the panel. Stickers, painting, ink stamps, silk screening, heat molded embedded designs are all ways to include the design or logo.

It is recognized by those skilled in the art that changes may be made to the above described embodiments of the disclosed technology without departing from the broad inventive concept thereof. It is understood, therefore, that this technology is not limited to the particular embodiments disclosed but is intended to cover all modifications which are in the spirit and scope of the disclosed technology.

We claim:

1. A panel for increasing the vertical extension of a basin wall to protect a person's torso from splashing liquid comprising:

a panel which acts as a shield for said torso by extending vertically beyond said basin wall, said panel maintained between said torso and said basin, thereby allowing said person to reach around said panel into said basin;

said panel having at least two suction cups at a bottom portion and on one side of the panel;

said suction cups attaching said panel to said basin wall such that said panel is easily attached and removed from said basin wall;

the said panel further comprises an aperture to hang said panel from when said panel is removed from said basin;

said panel is made of a flexible plastic material and folds over itself and attaches to itself, such that the panel is still attached to the sink and stores out of the way;

said panel is shaped as a dome side to side when in an unfolded upright position.

said at least two suction cups are two suction cups having stems that are first placed through keyway apertures in a bar and then the suction cup stems are placed through keyway apertures in a bottom part of said panel;

said two suction cups secured to a smaller section of both sets of keyway apertures;

said dome side to side of the panel is maintained by the suction cups placement having a narrower configuration than a distance between keyway apertures in the panel;

said bar keeping the suction cups in proper narrower configuration.

2. The panel of claim 1, wherein the panel further comprises:

a protrusion extension tab extending from a bottom edge of the panel;

said aperture is located near the top of said panel and when the panel folds over itself the aperture is hooked onto said protrusion extension tab and holds the panel in a folded over configuration.

3. The panel of claim 1, wherein the panel has a butterfly hinged area to fold the panel and the butterfly hinged area causes the panel to invert in an upright position.

4. The panel of claim 1, further comprising:

an additional suction cup located at the bottom portion or top portion of said panel and on an opposite side of the panel than the at least two suction cups;

when said panel is folded over the additional suction cup attaches to a folded over portion of said panel to hold the panel in the folded position.

5. The panel of claim 1 further comprising:

said panel is oval in shape and has an upper portion and a lower portion;

a living hinge and butterfly hinged areas between said upper and lower portions are used to fold the panel.

6. The panel of claim 1, further comprising:

a living hinge between an upper portion and a bottom portion of said panel used to fold the panel and;

an over center catch positioned on said living hinge which holds the panel in a substantially upright unfolded position when engaged.

7. The panel of claim 1, wherein top portion of said panel has a pin protrusion and bottom portion has a corresponding socket, such that when the pin protrusion is placed into the socket, the panel is held in a folded position.

8. The panel of claim 1, whereas the aperture is a hook at a top of said panel of said panel and when said panel is folded said hook snaps over a bottom edge of said panel holding said panel in a folded position.

9. A panel for increasing the vertical extension of a basin wall to protect a person's torso from splashing liquid comprising:

a panel which acts as a shield for said torso by extending vertically beyond said basin wall, said panel maintained between said torso and said basin, thereby allowing said person to reach around said panel into said basin;

said panel having at least two suction cups at a bottom portion and on one side of the panel;

said suction cups attaching said panel to said basin wall such that said panel is easily attached and removed from said basin wall;

said panel is made of a flexible plastic material;

said panel is shaped as a dome side to side;

said at least two suction cups are two suction cups having stems that are first placed through keyway apertures in a bar and then the suction cup stems are placed through keyway apertures in a bottom part of said panel;

said two suction cups secured to a smaller section of both sets of keyway apertures;

said dome side to side of the panel is maintained by the suction cups placement having a narrower configuration than a distance between keyway apertures in the panel;

said bar keeping the suction cups in proper narrower configuration.

10. A panel for increasing the vertical extension of a basin wall to protect a person's torso from splashing liquid comprising:

a panel which acts as a shield for said torso by extending vertically beyond said basin wall, said panel maintained between said torso and said basin, thereby allowing said person to reach around said panel into said basin;

said panel having a bottom detachably connected to a base;

said base having at least two suction cups on one side and said suction cups attaching said base to the basin wall;

and said panel is easily attached and removed from said base.

said panel is made of a flexible plastic material and folds over itself and attaches to itself, such that the panel is still attached to the sink and stores out of the way;

said panel is shaped as a dome side to side when in an unfolded upright position;

said two suction cups secured to a smaller section of both sets of keyway apertures;

said dome side to side of the panel is maintained by the suction cups placement having a narrower configuration than a distance between keyway apertures in the panel;

said bar keeping the suction cups in proper narrower configuration.

11. The panel of claim 10, wherein the panel further comprises:

at least three suction cups on a front bottom side of the panel;

the at least three suction cups having stems that are first positioned through corresponding apertures in a base;

after suction cup stems are positioned through the base, the suction cup stems are positioned through corresponding apertures in bottom of said panel;

said panel is removable from suction cup stems, such that the base and suction cups stay attached to said basin and said panel is removable and stored by hanging from an aperture on said panel.

12. A panel for increasing the vertical extension of a basin wall to protect a person's torso from splashing liquid comprising:

a panel which acts as a shield for said torso by extending vertically beyond said basin wall, said panel maintained between said torso and said basin, thereby allowing said person to reach around said panel into said basin;

said panel having at least two suction cups at a bottom portion and on one side of the panel;

said suction cups attaching said panel to said basin wall such that said panel is easily attached and removed from said basin wall;

the said panel further comprises an aperture to hang said panel from when said panel is removed from said basin;

said panel is made of a flexible plastic material and folds over itself and attaches to itself, such that the panel is still attached to the sink and stores out of the way;

said panel is shaped as a dome side to side when in an unfolded upright position;

said two suction cups secured to a smaller section of both keyway apertures;

the said at least two suction cups are two suction cups placed at an outside front bottom of said panel and have stems of equal height dimension;

said dome side to side of the panel is maintained by a third suction cup placed on an inside front bottom between said two suction cups and has a stem longer than the dimension of the two suction cup stems.

* * * * *